US012098880B1

(12) United States Patent
Anthony

(10) Patent No.: US 12,098,880 B1
(45) Date of Patent: Sep. 24, 2024

(54) APPARATUS FOR CHILLING BEVERAGES AND OTHER FOOD PRODUCTS AND PROCESS OF MANUFACTURE

(71) Applicant: INCAN USA LLC, Hohenwald, TN (US)

(72) Inventor: Michael Mark Anthony, Hohenwald, TN (US)

( * ) Notice: Subject to any disclaimer, the term of this patent is extended or adjusted under 35 U.S.C. 154(b) by 261 days.

(21) Appl. No.: 16/602,952

(22) Filed: Dec. 31, 2019

Related U.S. Application Data

(63) Continuation-in-part of application No. 14/120,540, filed on May 30, 2014, now Pat. No. 10,076,723.

(51) Int. Cl.
*F25D 31/00* (2006.01)
*F25D 3/14* (2006.01)

(52) U.S. Cl.
CPC ..... *F25D 31/007* (2013.01); *F25D 3/14* (2013.01); *F25D 2303/083* (2013.01); *F25D 2303/0841* (2013.01); *F25D 2331/805* (2013.01); *F25D 2331/809* (2013.01)

(58) Field of Classification Search
CPC .... F25D 31/007; F25D 3/14; F25D 2303/083; F25D 2303/0841; F25D 2331/805; F25D 2331/809
See application file for complete search history.

(56) References Cited

U.S. PATENT DOCUMENTS 3,494,142 A * 2/1970 Beck ..... F25D 3/10 62/294
3,874,557 A * 1/1975 Porter ..... B67B 7/24 222/80
4,002,235 A * 1/1977 Donnelly ..... C25D 17/02 206/219
4,784,678 A * 11/1988 Rudick et al. ..... F25D 5/02 62/4
5,845,501 A * 12/1998 Stonehouse et al. . F25D 31/007 62/62

(Continued)

FOREIGN PATENT DOCUMENTS

CN 103723766 A * 4/2014 ..... C01G 23/07

OTHER PUBLICATIONS

CN103723766A Translation (Year: 2014).*

*Primary Examiner* — Elizabeth J Martin
*Assistant Examiner* — Dario Antonio Deleon
(74) *Attorney, Agent, or Firm* — Frank L. Kubler

(57) ABSTRACT

A cooling apparatus includes an inner beverage container for containing a food product and having a rim and a side wall and a base dome, and an outer shell container having an open rim and a side wall and a base dome, where the inner beverage container is snugly fitted into the open rim of the outer shell container and a common lid on the container rims, and the inner beverage container is shorter than the outer shell container defining a dry gas chamber between the container base domes containing a dry gas and a cooling structure, and where the diameters of the inner beverage container is less than that of the outer shell container leaving a radial space between the container cylindrical walls defining a humidification liquid chamber containing a humidification liquid, and a deformable barrier between the dry gas chamber and the humidification liquid chamber.

51 Claims, 18 Drawing Sheets

(56) References Cited

U.S. PATENT DOCUMENTS

| | | | | |
|---|---|---|---|---|
| 2013/0086924 | A1* | 4/2013 | Farone et al. | F25D 5/00<br>62/4 |
| 2013/0270724 | A1* | 10/2013 | Albro et al. | B01F 3/04<br>261/128 |

* cited by examiner

*Fig.* 3

APPARATUS FOR CHILLING BEVERAGES AND OTHER FOOD PRODUCTS AND PROCESS OF MANUFACTURE

FILING HISTORY

This application is a continuation-in-part of application Ser. No. 14/120,540, filed on May 30, 2014.

BACKGROUND OF THE INVENTION

1. Field of the Invention

The present novel invention relates generally to the art of cooling food and beverage containers and to processes for manufacturing such containers. More specifically the present invention relates to an apparatus for cooling a food product such as a beverage, means and methods of cooling said containers with said apparatus, including methods of assembling and operating said apparatus. The terms "beverage," "food," "food products" and "container contents" are considered as equivalent for the purposes of this application and used interchangeably. The term "food product container" refers to any sealed and openable storage means for a food product meant for consumption.

2. Description and Examples of the Prior Art

There previously have been many self-cooling food product container devices for cooling the container contents in the form of a beverage or other food beverage food product container. These devices sometimes use flexible and deformable receptacles or rigid receptacle sides to store a refrigerant for phase change cooling. Some prior art devices use desiccants with a vacuum activated to evaporate water at low pressure and absorb vapor into a desiccant. Other prior devices use refrigerants stored between pressure vessels in liquid phase to achieve the cooling by causing a phase change of refrigerants from a liquid to a gaseous state. The present inventor has invented a variety of such devices and methods of manufacturing them. Several prior self-cooling food product container technologies rely on the evaporation of a refrigerant from the liquid phase to the gaseous phase. Some rely on desiccants only. Desiccant technologies rely the thermodynamic potential of a desiccant to absorb water from a gaseous phase into the desiccant to effectuate the evaporation of water in a vacuum. These earlier inventions do not satisfy all the needs of the beverage industry and they do not use electromotive heat transport means to cool a beverage. In fact, they are so structurally different from the present invention, that one skilled in the art cannot possibly transcend from the prior art to the present invention without an inventive process. In an effort to seek a cost effective and functioning apparatus for self-cooling a beverage food product container, the present inventor has done a variety of experiments to arrive at the present novel method. The following issues have kept the cost-effective commercialization of all prior art devices prohibitively high.

Prior art that uses liquefied refrigerants fail to address the real issues of environmental green house and global warming issues. They also fail to address manufacturing and beverage plant operations that are crucial for the success of a self-cooling food product container program. Some such prior art designs require pressurized food product containers to store liquid refrigerants. The only liquid refrigerants that can be stored between commercially viable pressure canisters are HFCS, CFCS, hydrocarbons, ethers, and other highly flammable low-pressure gases. These gases are not commercially viable and have led to difficulty in implementation of such technologies. Most commercial refrigerants are ozone depleting and global warming and as such have been banned by the EPA in the USA and other governing bodies for direct release into the atmosphere as products of a self-cooling food product container. The EPA has mandated that no refrigerant be used in a self-cooling food product container except $CO_2$ and if used, the design must be safe. Refrigerants currently available cause both global warming and ozone depletion. Generally, they are common refrigerants such as 134*a* and 152*a*. In some cases, flammable gases such as butane and propane have been tried but the risk factors are high for several reasons. Firstly, the use of such technologies in a closed room can cause a variety of effects including asphyxiation, poisoning and so on. Second the flammability of some refrigerants limits the number of food product containers that can be opened in a closed environment such as during parties or in a vehicle. The present inventor has several patents on these prior technologies, has experimented with several of these technologies and has found them to be unsuitable for commercial viability. Further, the cost of refrigerants is very prohibitive and the cost of cooling cannot justify the use of refrigerant gases.

Prior art that uses cryogenic refrigerants such as $CO_2$ fail to address the real issues of manufacturing and beverage plant operations that are crucial for the success of a self-cooling food product container program. All such prior art designs require very highly pressurized food product containers to store the cryogenic refrigerants. Some technologies that promise to use $CO_2$ have implemented carbon traps such as activated carbon, and fullerene nanotubes to store the refrigerants in a carbon matrix. These added desiccants and activated carbon storage systems are too expensive to implement commercially and further, the carbon and other absorptive media that lowers the pressure can contaminate the beverage products. Therefore, there is a need to reduce the quantities of such chemicals needed. Cryogenic self-cooling food product containers require the use of very high pressure vessels, and cryogenic gases such as $CO_2$, and they also require expensive containers made from high pressure bearing materials such as aluminum, steel, or fiber-glass. They are essentially dangerous, since the pressures involved are generally of the order of 600 psi or more. Further, they are complicated since the pressures involved are much higher than a conventional food product container can withstand.

Desiccant-based self-cooling food product containers require the desiccant to be stored in a an evacuated chamber separated fluidly from water stored in a separate chamber. When the vacuum is released between the two compartments, water vapor is pulled into the vacuum and then absorbed by the desiccant and heat of evaporation is taken from the cooled item and transported to condense in the desiccant. The heat taken by the evaporated water heats up the desiccant and must not be allowed to interact with the beverage, otherwise it would reheat the beverage again. It is very difficult to maintain for a long period a true vacuum in chamber adjacent to a water containing chamber since the permeability of the barrier used to separate the desiccant chamber from the water chamber contributes to the efficiency of cooling, and the thicker the barrier required the more expensive it becomes to manufacture. Further, the valves and activation devices used by prior art using a desiccant cooling means require stiff pins, knives, and so on. Further, the vacuum must be maintained for a long period of storage time and often fails. Migration of moisture into the desiccant can destroy the cooling capacity of such devices. Further, it is extremely difficult to handle desiccant crystals the way prior art designs are implemented, and powders in a mass-manufacturing environment where the desiccant has to be maintained moisture free and contaminant-free inside a pressurized beverage food product container is extremely difficult to realize. Thus, a better technology is needed to handle these desiccants separately from the food product container. Further, the heat absorption potential of desiccants reduces as the vacuum is released and evaporation starts and the process becomes inefficient by itself and becomes limited to the amount of desiccant used.

The problems presented by vacuums, including difficulties in creating and maintaining them and the lack of efficiency have been encountered in other fields as well. An early example can be found in the evolution of Thomas A. Edison's light bulb. His first practical incandescent lamp, for which he received a patent in 1879, included a carbonized bamboo filament contained within an evacuated glass bulb. Although it arguably propelled the world into a new era, it was initially highly inefficient. Then in 1904, European inventors replaced the carbonized bamboo filament with tungsten, and in 1913 it was discovered that replacing the vacuum within the bulb with an inert dry gas doubled its luminous efficiency. Although this field of art is different from the present one, and the technical issues presented were quite different, this is perhaps a thought-provoking example of an advance in product efficiency resulting from the replacement of a vacuum with a dry gas.

In general, these prior art technologies are not cost-effective technologies and they rely on extremely large and complicated canister designs in relation to the beverage food product containers within which they are contained. In fact, the ratio of desiccant to water is about 3:1 and the ratio of the volumetric loss in such beverage food product containers is about 40%. The cost of the desiccant or sorbent, the cost of the food product container, and the cost of the process of manufacture are prohibitive, despite nearly 20 years of trials. Thus, it is advantageous to reduce the amounts of these components needed and to restructure the manufacturing process to divorce the interior of the food product container from these chemicals.

Prior art also reveals chemically endothermic self-cooling food product containers. These rely on the use of fixed stoichiometric reactions of chemicals to absorb heat from the food product container contents. These prior art technologies require two containers that may be connected by a breakable membrane and other means. They particularly do not allow the sorption of the humidification liquid to be achieved by automatic vacuum generation within the chemical chamber to permit complete solvation and complete use of the maximum surface area available.

The present invention differs from all the mentioned prior art and provides a novel cost effective and thermodynamically simple and viable means for cooling a beverage in a food product container by using the cooling potential of fixed amounts of reactants using electromotive force of a dry gas acting on a humidification liquid of suitable choice. Many trials and designs have been made to obtain the present configuration of the disclosed invention.

Prior Research by Present Inventor on Beverage Containers that LED to the Present Invention U.S. Pat. No. 6,065,300 issued to the present inventor on May 23, 2000 shows a configuration in which a plastic container serves the purposes of the inner beverage container, while the outer shell container is a conventional beverage container of the standard can design.

U.S. Pat. No. 6,418,731B issued to the present inventor on Jun. 16, 2002 also shows a to configuration in which a plastic container serves the purposes of the inner beverage container, while the outer shell container is a conventional beverage container of the standard can design. However, in both these patents, a conventional liquified refrigerant gas is used to fill the space between the two containers and serve as a refrigerant. Due to environmental reasons, such gases cannot be used for a self-cooling container.

U.S. Pat. No. 6,817,202 B1 issued to the present inventor on Nov. 16, 2004 and U.S. Pat. No. 6,581,401 B1 issued to the present inventor on Jun. 24, 2003, both illustrate a means of using carbon matrices to store $CO_2$.

U.S. Pat. No. 5,946,930 issued to the present inventor on Sep. 7, 1999, shows how Carbon Fullerene nanotubes can be used to encapsulate $CO_2$ under pressure. These inventions are a precursor to the present invention which uses a dry gas such as $CO_2$, a humidification process in combination with an endothermic disintegration of a cooling structure to cool a beverage.

Deficiencies of Prior Art Devices that Use Endothermic Cooling Systems, and Objectives of the Present Invention a) Endothermic cooling systems of the prior art have a limited potential to solvate and then cause cooling since the solvation energy of the ionizable compounds used, for example, usually depends on the temperature of a solvent such as water. The water acts as humidification liquid to ionize chemicals, and as the ions redeem energy of solvation as the solvent cools, the process becomes energy deficient, making the process of extraction of solvation energy exponentially slow, and as such, these technologies do not use the full potential of the solvation energy available. For example, to cool 16 oz of beverage by 30° F. one needs to dissolve at least 127 g of potassium chloride in about 380 g of water. This is not commercially viable in a self-cooling food product container technology that relies only on this process. The present invention overcomes this deficiency by means of an extremely dry gas. Dry gas with a dew point of 10° F. to −150° F. can easily absorb vapor from a liquid that is cooled to freezing point without a vacuum. The interstitial spaces between endothermically reacting chemical compounds used in crystalline form as reactants is considerable. As a matter of fact, well over 40% of the free interstitial space between such crystalline structures is not used for cooling. Further, dry gas simply increases its dew point temperature when it absorbs moisture, while the actual thermometric temperature of the dry gas itself remains constant.

b) Further, stored endothermically reacting chemical compounds used for endothermic cooling with a solvent such as water require a stoichiometric molar ratio with water for the purpose of cooling. The main problem with prior the art is the fact that the water must be allowed to enter into the solutes and dissolve the solute leaving a void where the water is stored as an empty space that serves no purpose whatsoever. Further, the water is allowed to enter into the chamber holding the reacting chemicals and cooling is generated such that the cooling generally occurs at a lower level than the headspace leaving the headspace of the beverage uncooled. Since cold liquids tend to fall to lower levels by gravity, no cooling occurs above the reactant space just below the water top level. This problem is solved by the present invention by means of a dry gas cooling structure infused with trapped dry gas which dissolves in the humidification liquid and generates a dry gas to completely intermingle with humidification liquid into the solutes chamber regardless of orientation of the apparatus in the beverage container. This also allows the cooled solution to be turbulent and complete contact the dry gas chamber walls and thus cool the product more efficiently. Further, all interstitial spaces in the dry gas cooling structure are used for cooling as the solvent is pulled by the dry gas to further absorb moisture from humidification liquid to further cool.

c) The present invention using a cooling structure that can take the form of a cooling membrane and as a solid block cooling structure that can release a dry gas such as stored substantially dry $CO_2$, and efficiently eliminates the need to maintain dry gas at elevated pressures over a long period of time. The pressure is immediately generated by the absorption of humidification liquid by cooling structure which then releases the dry gas under pressure. This solves the issue of minimizing the volume occupied by the solute in the apparatus as it dissolves into the solvent.

d) Advantageously, the present invention does not necessarily require pins, knives and other methods to introduce water vapor to the reacting chemical compounds. The interesting aspect of the invention is that it allows the apparatus to be sealed by conventional beverage bottling plant seaming means such as with standard canning plant seaming rollers. Further, as an added advantage, the present invention uses only two standard beverage containers to manufacture it, and does not need any further manufactured components other than the dry gas cooling structure and a gas permeable membrane.

Development of the Present Invention and its Essential Components

Dry Gas

Dry gas such as substantially dry air, preferably substantially dry $CO_2$, substantially dry Nitrogen, substantially dry Dimethyl ether, several other types of dehumidified gases such as Solstice® L41y (R-452B), Solstice® 452A (R-452A), Solstice® L40X (R-455A), Solstice® zd, Solstice® ze, (R-1234ze), Solstice® yf (R-1234yf) with very low dew point temperatures can cause extreme cooling.

Dry air in particular can cause extreme cooling as is evidenced by weather patterns that are predominantly driven by the humidity of air and heat energy available in the atmosphere. Not surprisingly, dry air can result in dramatic snow and ice formation, in turn resulting in extreme weather patterns across the world. It is not surprising that lip-balm used for dry lips sells well in winter. From hurricanes to tornadoes, to heavy snow storms, and icy winter storms, nature has provided an amazing electromotive heat transport means that can be emulated to assist in cooling a beverage and a food product using humidification and dehumidification of air. It is my theory that the tremendous vacuous energies of a tornado are a result of the sudden condensation of water vapor from the dehumidification of humidified dry air. Water vapor is 1840 times the volume of the same weight of liquid water, and so when a huge cloud condenses, a tremendous reduction in volume is obtained resulting a vacuum which appears as a funnel cloud of a tornado. No simple wind motion can generate such tremendous energies. Similarly, the humidification of very dry air results in very cold temperatures that results in snow storms. This happens as moisture is picked up by dry air and evaporated to remove heat from the surrounding environment followed by saturation of the same wet air which again deposits its vapor as moisture in as snow and hail.

Water has the best thermodynamic potential to cool a food product. It has the highest heat of evaporation and as such it can be used in combination with electromotive drying and regenerative processes that also rely on water molecules to cool a food product container. However, water does not easily evaporate due its high heat of evaporation and as such it must be "enticed" to do so by an appropriate means. Further, as water cools, for example in an endothermic reaction, and in a desiccant evaporation system, it becomes more and more difficult to evaporate it. Thus, neither regular endothermic cooling such as in conventional cold packs nor conventional desiccant cooling systems of prior art by themselves prove to be the most efficient forms of cooling a food product such as beverage. The combination of dry gas mediation, endothermic solvation and the generation of a pressurized dry gas such as $CO_2$ and other cooling methods can use the two fundamental substances, water endothermic cooling and a dry gas, to effectively increase the thermodynamic potential to cool a food product. However, an inventive step of pressure generated by the interaction of dry gases and a humidification liquid to maximize the cooling surface area of the apparatus is intended. Further, the additional inventive step of using standard beverage containers to form the humidification liquid and the dry gas chamber is intended. Further, the additional inventive step of using the solvation of chemicals to generate pressurized dry gas for the purposes of maximizing the contact of cooling means with the beverage container used for the invention is intended.

a) The Cooling Structure

In the late 1930's, Samuel S. Kistler discovered that when certain substances such as silica dioxide and activated carbon are subjected to high pressure gases at supercritical state, the gases migrate through the pores of the silica and fill the material like a sponge. If the pressure is relieved, then the gases are released from the pores of the structure to gradually leave the unpressurized gas within said pores without fracturing the material. This property made the silica extremely porous and light and imparts amazing properties to the structure thus formed that has been called Aerogel. Aerogel is made of 2%-5% silica dioxide and has an open-pore structures similar to honeycomb. The cooling structure of the present invention is meant to have the desirable properties of storing gases that can be released when need to perform the function of cooling a beverage. However, to effectively create a cooling structure 107 with a pressurized dry gas DG storage means for release at a prescribed time, simply storing unpressurized gases in a porous structure will not do. It is essential that the gases remain in a pressurized state within the porous structure over time and that a means of preventing these gases from exiting the pores be provided. Therefore, the inventor has developed a means of doing this using a combination of urea and other endothermic salts E that will be described hereunder.

In experiments using dry-ice, the inventor found that an effective gas storage cooling structure 107 can be made with dry ice pellets and molten urea with certain salts and carbonates. When densely formed dry-ice cylindrical pellets of small dimensions (1 mm dia×2 mm length) are projected at high momentum as projectiles into molten urea, the urea crystallizes over them before they substantially start to sublimate. The electronic rate of recrystallization of urea is far faster than the sublimation rate and has a tremendously stronger bonding strength than the pressure forces exerted by the sublimation of densely packed small sectioned dry-ice pellets. Thus, the dry ice is encapsulated in the crystalline structures that form around them as urea crystals until it sublimes and becomes micro nodules of gaseous and liquefied $CO_2$ encased in the crystalline structure of the urea. The shrinkage of the urea around the gas as crystalline pores formed by the gas is even capable of forming extreme nano-containment pores that hold the gas under pressure. Several types of gases, such as dimethyl ether (DME) can be encapsulated in the crystalline structures that is formed from the urea crystals when compressed at very high tonnage above 10 tons to 50 tons of compressive force using a conventional hydraulic press for example. The shrinkage of the urea crystals around the gas forms crystalline pores that hold the dry gas under pressure. It is important that gas used be a dry gas since any moisture present during the compression molding of the dry gas cooling structure can result in failure of the encapsulation. PTFE fibers may be added to the urea crystals and then compressed in a mold in the presence of a high pressure dry gas to form the cooling structure.

This is very much the same process as the formation of aqua marine crystals when as the magma cools and solidifies under pressure, water and steam that is trapped does not readily dissolve into the magma and becomes concentrated in cavities of the gem. These pockets eventually crystallize to form a special type of rock called a pegmatite.

Subsequent long-term research by the present inventor shows that $CO_2$ in combination with a storage matrix comprising of one of Urea, and Urea in combination with activated carbon, PTFE micro fiber cores, and naturally occurring salts and carbonates can be used to achieve an environmentally friendly and safe self-cooling beverage container. Advantageously, in this new invention, a dry gas such as $CO_2$ can be effectively stored and released in a specially made cooling structure to combine with endothermic salts and achieve adequate cooling of a beverage. Firstly, the endothermic cooling is enhanced by agitation of the $CO_2$ released. Secondly the dry gas absorbs water as vapor and additionally cools the beverage container. Thirdly, the phase change and expansion of the $CO_2$ released during the fragmentation of the endothermic cooling structure further cools the product. Fourthly, the entire structure can be made using conventional manufacturing processes.

b). Paired Beverage Containers

The cost of manufactured containers has been reduced by present day technology especially in the beverage industry. The thickness, weight and costs of aluminum beverage containers provide an ideal standard for commercializing a self-cooling container. Thus, this invention uses conventionally available elements from the beverage industry to provide for a very efficient and low cost self-cooling container.

Paired inner beverage containers can be used to form chambers that serve the purposes of a dry gas chamber and a humidification liquid chamber to achieve the goals set forth in the invention. The invention uses paired containers to form an outer shell container and an inner beverage container. It further uses a conventional lid to completely form a self-cooling container. These paired containers being commercially available can be used from the stock of Standard Cans and the Slim cans that are available in the market place. The Standard cans generally come as 12 oz, 16 oz, 19 oz and 24 oz cans. The Slim cans generally come as 12 oz, 8.5 oz and 6.5 oz. The cans generally have similar diameters and vary only in height. Any combinations of a Standard Can and a Slim Can may be used for the purposes of this invention.

For the purposes of this invention, an inner beverage container is required to be inserted snugly through the outer shell container open rim into the outer shell container to form an annular radial space between the two containers that essentially forms the humidification liquid chamber. The cylindrical space between the outer shell container base dome and the inner beverage container base dome forms a dry gas chamber. A compressible barrier structure formed from one of wax, plastic, rubber and putty is preferably used to form an cylindrical fluid barrier between the two containers and thus form the dry gas chamber and the humidification liquid chamber close to the inner beverage container bottom edge and the outer shell container inner cylindrical wall. Natural waxes are hydrophobic and environmentally friendly and provide a good cheap alternative to welding plastic structures that can separate the two chambers.

c). Combining Dry Gas, a Cooling Structure and Paired Beverage Containers.

A paired set of beverage containers is used to form a beverage chamber, a dry gas chamber, and a humidification liquid chamber simultaneously. In the present invention, the dry gas chamber contains a cooling structure impregnated with a dry gas within a dry gas chamber that is formed between paired beverage containers. The purpose of the cooling structure serves to release dry gas and cool and additionally to cool the beverage by endothermic solvation. The cooling structure also serves to chill the outer shell container inner cylindrical wall as the cooling structure dissolves endothermically in the humidification liquid releasing trapped dry gases that further cool the by expansion, phase change, and by absorption and humidification of the released dry gas. The cooling of the outer shell container 200 is not a necessary part of the invention, however it provides a physiological advantage that is invaluable as an indicator of the cooling process. Thus, a tremendous amount of cooling can be achieved by this method by using a dry gas and a humidification liquid as compared to a regular endothermic process alone.

d) The Filtration Membrane

Any endothermic process that uses a humidification liquid will have the problem of leaking the fluid when gases escape from the device. Thus, it is imperative that means to prevent the passage of humidification liquid from within the apparatus be considered while still allowing gases to escape from within the cooling apparatus through a vapor passageway. In this invention a filtration membrane is provided. The filtration membrane is a simple thin PTFE membrane that allows gases to pass through while preventing liquids from passing through a vapor passageway. Filtration membranes can be obtained from companies such as Porex, Fluoropore™, and Omnipore™, and Sterlitech. The filtration membrane is used to prevent any liquids from passing through a vapor passage way while only allowing gases such as $CO_2$ to pass through from a humidified cooling process to atmosphere from the interior of the outer shell container. A carbon disc may also be used as a filtration membrane, and in such a case it must be made thin and porous enough to allow gases to pass through its structure while preventing liquids from passing through it. A cheap filtration membrane can be made using VaproShield™ membranes typically used as breathable moisture barriers in homes. VaproShield™ is a very inexpensive moisture barrier that is commercially available and comes in a self-adhesive form that is easy to use as a filtration membrane for the purposes of this invention. Since the exposure time of the liquid used in the invention is minimal, VaproShield™ can be used even when it disintegrates over a period of days after use. These inexpensive membranes are available in large inexpensive sheets from hardware stores such as Home Depot™ and Lowe's™.

The filtration membrane is hydrophobic and thus does not allow liquids to pass through its pores but will allow gases to pass through its pores. The vapor passageway and a filtration membrane thus accords a means of passing a dry gas DG from within a self-cooling apparatus to atmosphere without loss of liquid, such as described in this invention.

Definitions

The following definitions are generally used to describe some terms used in the present disclosure to describe this invention.

"Filtration Membrane" shall mean a thin hydrophobic membrane disc made from one of Polytetrafluoroethylene (PTFE) and activated carbon, with pore sizes such as 0.05 um, 0.10 um, 0.22 um, 0.45 um, 1 um, 2 um, 3 um, 5 um, for preventing liquid from exiting the apparatus during use while allowing gases to exit the apparatus.

"Dry gas" for the purposes of this application, shall mean a gas with a substantially low partial water vapor pressure with a dew point temperature less than 50° F. that fills interstitial spaces between particles of endothermically reacting compounds. It is noted that the dry gas itself could be liquefied and mixed in with said endothermically reacting compounds;

"Wet gas" for the purposes of this application, shall mean a dry gas humidified to have a higher water vapor pressure than dry gas and a dew point temperature greater than 10° F.

"Dry gas cooling structure" shall mean a composite compressed structure infused with a dry gas either in gaseous form or in liquefied form, and made with materials comprising of a combination of one or more of urea, sodium bicarbonate, acetic acid, potassium chloride, ammonium nitrate, activated carbon, wax and a PTFE fibers.

"Cooling structure" shall mean the same as Dry gas cooling structure.

"Cylindrical groove" shall mean an inwardly roll formed structure on a cylindrical portion of beverage container wall.

"Food product" for the purposes of this application shall mean any substance that is a consumable item preferably a liquid beverage; "Dew point temperature" for the purposes of this application shall mean the temperature at which the vapor of a humidification liquid in a sample of dry gas at constant barometric pressure condenses into humidification liquid at the same rate at which it evaporates.

"Headspace" for the purposes of this application shall mean the carbonation filled space in a sealed beverage container that is above the beverage level.

"Heat transport means" for the purposes of this application, shall mean a thermodynamic and electromotive potential to exchange heat between substances; "Outer shell container" shall mean a conventional metal beverage container made in the form of a such as containers made by Ball Corporation, and can be made in volumetric sizes ranging from 12 oz to 32 oz and having conventional 202, 204 and 206 specifications for the open end.

"Inner beverage container" shall mean a beverage container that is made to contain a beverage or food product and made in the form of a conventional "Slim Can" such as made by Ball Corporation that snugly slides through the open rim of an Outer shell container and having conventional 202, 204 and 206 specifications for the open end with a diameter and height less than an Outer shell container.

"Sealing membrane" shall mean a thin membrane made from one of paper, and plastic, and metal foil and forms a non-permanent seal covering a filtration membrane.

"Compressible barrier" for the purposes of this application shall mean any structure made from materials such as a wax, a rubber, a plastic, a metal used to form a temporarily fluid seal preventing humidification liquid from passing through it and that can be disrupted by gas pressure and by finger pressure to open said temporarily fluid seal.

"Interconnection structure" for the purposes of this application, shall mean a segment of the walls of the segments of the wall of the outer shell container form the compressible barrier between a dry gas chamber and humidification liquid chamber such as an cylindrical groove.

"Collapsible" for the purposes of this application shall mean the reduction in volume of a closed space without a change in the surface area of the walls enclosing said volume.

"Humidification liquid chamber" for the purposes of this application shall mean a space containing humidification liquid.

"Humidification liquid" for the purposes of this application shall mean any liquid that is used to react with endothermically reacting chemical compounds to generate endothermic cooling and such liquid may include water and beverage.

"Humidification liquid vapor" for the purposes of this application shall mean the vapor of any humidification liquid.

"Dry gas chamber" for the purposes of this application is a functional structure that preferably contains a dry gas and may hold endothermically reacting chemical compounds in the form of solids or liquids within it.

"PVC" for the purposes of this application shall mean heat-shrinkable polyvinyl chloride.

"PET" for the purposes of this application shall mean heat-shrinkable polyethylene terephthalate.

"Upright" for the purposes of this application shall mean vertical orientation.

For orientation purposes and clarity, the food product container is assumed to be standing in an upright, vertical orientation with the food product container's bottom resting on a horizontal plane.

This invention uses the thermodynamic potential of endothermic solvation in combination with the evaporation of a humidification liquid such as water, water-ethanol azeotropes, dimethyl ether-water azeotropes, or a suitable liquid and the ability of a substantially low vapor pressure medium such as a dry gas to force this evaporation from even cold liquids.

Objects of the Invention

It is a primary object of the present invention to provide a completely environmentally friendly self-cooling container that uses Environmentally friendly components.

It is another object of the present invention to provide a method of cooling a beverage container using a novel simple means to remove heat from a food product using dry gas with endothermic cooling structures.

It is another object of the present invention to provide a method of assembling the self-cooling a beverage container in its completed form using a pair of dimensionally matched aluminum or plastic cans such as the "Slim Can" as an inner beverage container and "Standard Can" as a shell container.

It is still another object of the present invention to provide a self-cooling apparatus for cooling a beverage container using conventional filling and seaming means.

It is a further object of the present invention to provide an apparatus that uses the humidification of a substantially dry gas generated by endothermic solvation of a substrate in a cooling structure to absorb and evaporate water from solution to generate cooling.

It is a still further object of the present invention to provide an apparatus that uses a dry gas to evaporate a liquid to further cool by evaporation.

It is an additional object of the present invention to form a dry gas chamber and a humidification chamber by means of jointly seaming a conventional beverage lid with a score portion and an opening means, such as a 202, a 200, or a 204 beverage lid with a standard beverage container to form outer shell container that concentrically surrounds an inner beverage container to form a humidification liquid chamber and a dry gas chamber simultaneously.

It is a still additional objective of the present invention to form a compressible barrier between a dry gas chamber and a humidification liquid chamber for the purposes of the present invention by roll-forming the diameter of a portion of a standard beverage container acting as an outer shell container at some location around its cylindrical wall to form a snug diametric fit against the outer surface of a diametrically smaller diameter standard inner beverage container.

It is a yet additional object of the present invention to form a separation as a compressible barrier between the dry gas chamber and the humidification liquid chamber by melting and cooling either a wax or soft molten plastic.

It is a still additional object of the present invention to use a gas-liquid separation membrane such as a POREX Corporation PM17Y and PM10Y disc membranes, Fluoropore™ and Omnipore™ Disc membranes and Sterlitech Corporation disc membranes, to prevent humidification liquid from exiting the apparatus at any time while allowing only gases to exit the apparatus.

It is finally an object of the present invention to provide an apparatus that is thermodynamically simple, viable, and cost effective for removing heat from a food product and thereby cooling the same.

SUMMARY OF THE INVENTION

The present invention accomplishes the above-stated objectives, as well as others, as may be determined by a fair reading and interpretation of the entire specification.

An apparatus for chilling beverages and other food products includes an inner beverage container for containing a food product and having a rim and a side wall and a base dome, and an outer shell container having an open rim, and a side wall and a base dome, and a lid with a release port and release port opening means, where the inner beverage container is snugly fitted into the open rim of the outer shell container and has a height less than that of the outer shell container so that there is a cylindrical space between the inner beverage container base dome and the outer shell container base dome defining a dry gas chamber containing a dry gas and a cooling structure, and where the diameter of the inner beverage container cylindrical wall is less than the diameter of the outer shell container cylindrical wall so that there is a radial space between the inner container cylindrical wall and the outer container cylindrical wall defining a humidification liquid chamber containing a humidification liquid, and a barrier between the dry gas chamber and the humidification liquid chamber, which can be deformed and opened by compressing and releasing the outer shell container cylindrical wall to permit the humidification liquid and dry gas to mix and thereupon endothermically cool the food product inside the inner beverage container.

Another embodiment of the apparatus reverses the chambers, so that the humidification liquid chamber is defined by the space between the container domes and the dry gas chamber is defined by the radial space between the container cylindrical walls. For both embodiments, the barrier preferably is formed of wax or a similar substance. The cooling structure in the dry gas chamber is impregnated with a dry gas.

BRIEF DESCRIPTION OF THE DRAWINGS

Various other objects, advantages, and features of the invention will become apparent to those skilled in the art from the following discussion taken in conjunction with the following drawings representing the preferred embodiments of the invention, in which.

DESCRIPTION OF THE PREFERRED EMBODIMENTS

Figure 1:
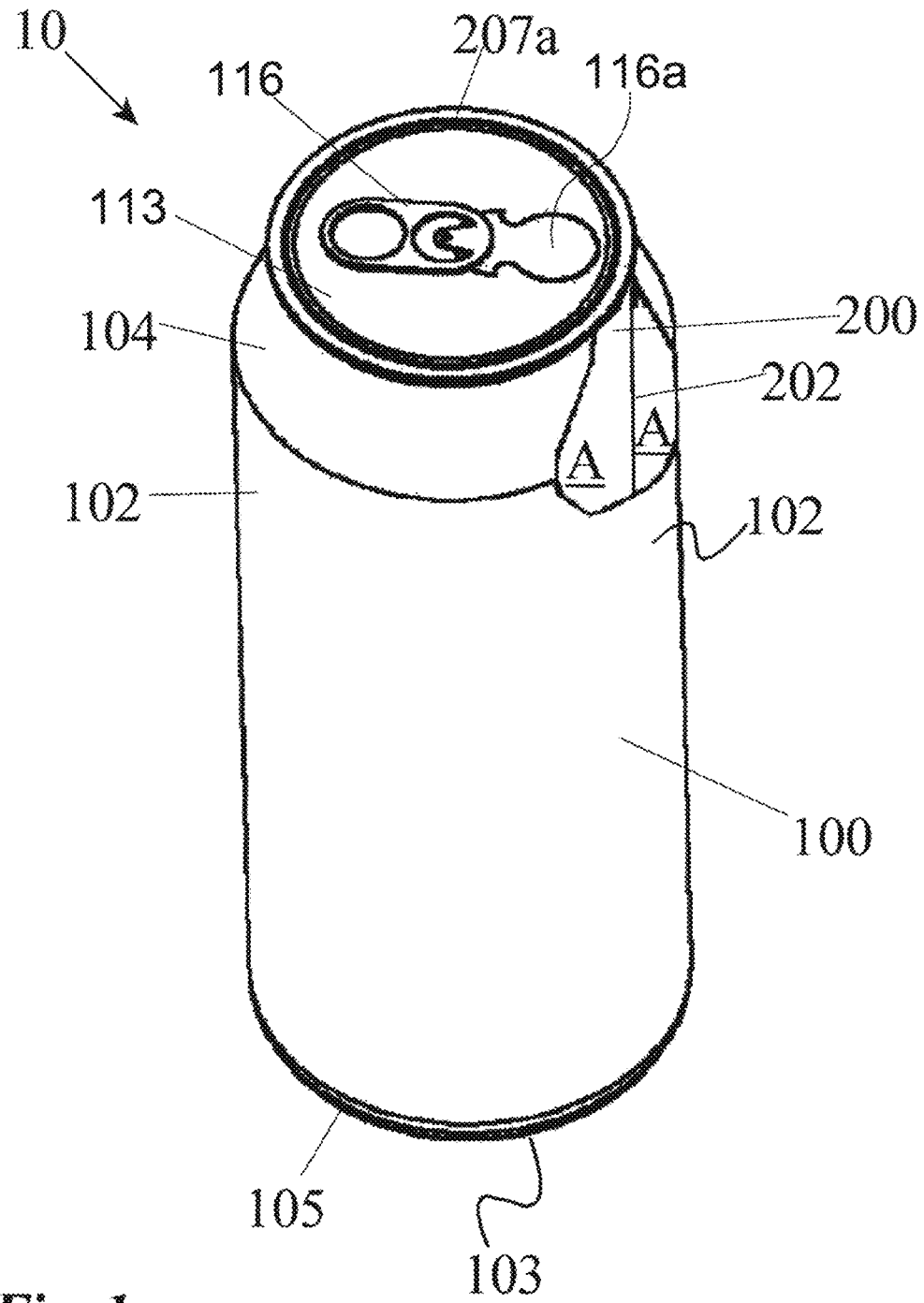
FIG. 1 shows the apparatus according to the embodiments of the invention. A standard metal beverage container in the form of a standard beverage can is shown as an outer shell container of the apparatus. The inner beverage container is shown co-seamed with the outer shell container by a Lo beverage container lid to form a cylindrical chamber holding a cooling structure.

As required, detailed embodiments of the present invention are disclosed herein; however, it is to be understood that the disclosed embodiments are merely exemplary of the invention which may be embodied in various forms. Therefore, specific structural and functional details of apparatus 10 disclosed herein are not to be interpreted as limiting, but merely as a basis for the claims and as a representative basis for teaching one skilled in the art to variously employ the present invention in virtually any appropriately detailed structure. For purposes of description, the outer shell container and the inner beverage container shall and may be referred to jointly as the "containers".

Reference is now made to the drawings, wherein like characteristics and features of the present invention shown in the various FIGURES are designated by the same reference numerals.

For orientation purposes and clarity, the Apparatus 10 is assumed to be standing in a vertical orientation in a normal placement orientation of a beverage container of the conventional kind. This invention uses the thermodynamic potential of endothermic solvation, and the endothermic evaporation of a humidification liquid HL in a dry gas environment cool a beverage.

First Embodiment of the Present Invention and Method of Manufacture

Figure 2:
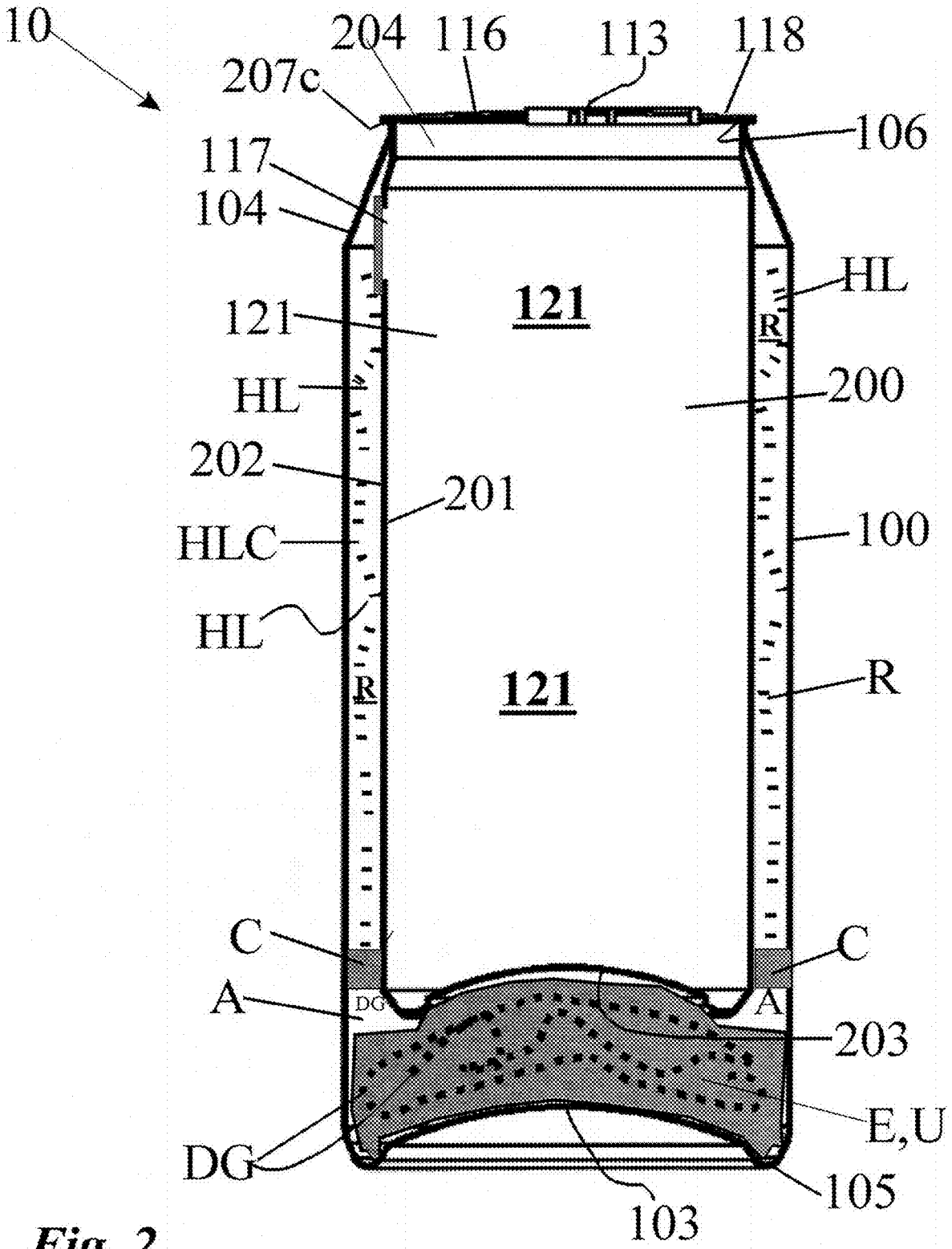
FIG. 2 shows a cross-sectional view of the apparatus according to the first embodiment comprising a humidification liquid chamber containing a humidification liquid, a dry gas chamber containing a cooling structure. The dry gas chamber is shown as being a concentric chamber between the inner beverage container and the outer shell container. A compressible barrier made from one of a compressible wax, plastic, and putty is shown separating the dry gas chamber from the humidification liquid chamber.

Referring to FIGS. 1 and 2, an apparatus 10 for cooling beverages and other food products is disclosed, including two beverage containers with matched sizes, namely, an outer shell container 100 and an inner beverage container 200. The inventor has discovered that two conventional beverage containers have such matching sizes. The outer shell container 100 and the inner beverage container 200 are chosen such that the outer diameter of the inner beverage container 200 fits snugly through the outer shell container open rim 106 which has a slightly larger diameter than the inner beverage container outer cylindrical wall 202. The inner beverage container 200 is chosen to have a height that is less than that of the outer shell container 100.

The gap between the height of the outer shell container base dome 103 and the height of the inner beverage container base dome 203 forms a cylindrical space A between them. The gap between the diameter of the outer shell container cylindrical wall 111 and the diameter of the inner beverage container cylindrical wall 201 forms an annular radial space R between them. The cylindrical space A forms a dry gas chamber DGC that will hold a cooling structure 107 impregnated with a dry gas DG, and the annular radial space R forms the humidification liquid chamber HLC that will hold a humidification liquid HL.

Figure 11:
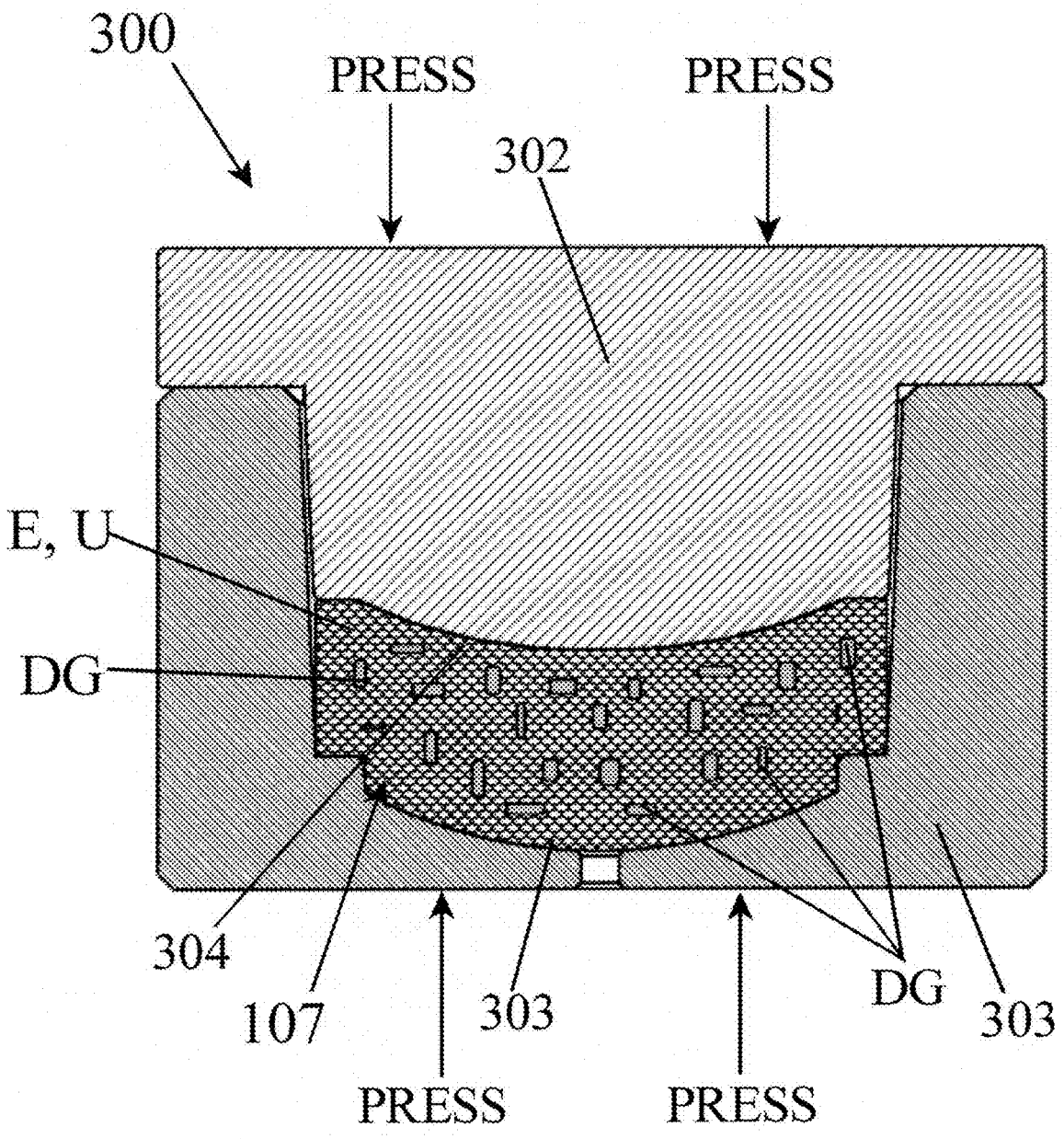
FIG. 11 shows an example of a mold to form the cooling structure by using a press to compression mold it.

The first method of forming the cooling structure 107 is by means of using a mixture of dry-ice pellets that are densely packed with crystalline urea and salts to compressively form the desired shape and size of the cooling structure 107. Dry ice pellets are commonly made for industrial use and the density of the packing of the dry ice determines its sublimation rate and eventually its life span as a solid. It is thus important that the dry ice to be used for making a cooling structure 107 that is very dense. If prepared in small batches, a mold 300 acts as a high-pressure molding vessel with a re-sealable closure. See FIG. 11. The mold cavity 301 must be a relatively strong and able to withstand high pressures. A gas feeding valve and a gas release valve may be provided in the mold cavity 300 to allow high pressure dry gas DG to enter into the mold cavity 301. A mold cavity 301 must be made of a suitable metal such as stainless steel. The mold cavity 301 is a two-part mold with a male mold 302 and a female mold 303 to form the cooling structure 107 by compressing the urea U with the endothermic salts E. It is desirable that the two cavities be machined to form a mold cavity 301 that closely fits the shape and size of the dry gas chamber DGC longitudinal cylindrical space A between the two containers 100 and 200. As such the mold 300 must have a dome cavity 304 that matches the inner beverage container base dome 203, and a reverse dome cavity 305 that matches the outer shell container base dome 103. An example of such a mold 300 and a mold cavity 301 is shown in FIG. 11.

The shape of the mold cavity 301 is designed to maximize the volume of the cooling structure 107 such that it fills the dry gas chamber DGC according to the first embodiment as shown in FIG. 2. The cooling structure 107 can also be formed in any shape or size as long as it can be configured to maximize its volume in relation to the dry gas chamber DGC.

The mold cavity 301 can be heated and lined with a very thin wax layer for easy release of the compressibly-formed cooling structure 107 by melting the thin wax coating inside the mold cavity 301 to release the cooling structure 107. The general thickness and shape of the cooling structure 107 for to the first embodiment is determined by the differences in height between the inner beverage container 200 and the outer shell container 100. A general difference of about 1 inch between the standard beverage containers is provided by the readily available cans such as the 8.5 oz 200 Slim Can™ for the inner beverage container 200, and the 12.0 oz 202 Slim Can™ for the outer shell container 100, both manufactured by Ball Corp™ for example, and other canning companies. For example, the inner beverage container 200 can be chosen to be a 8.5 oz Slim Can™ with a 200 neck configuration with the chosen outer shell container 100 being to be a 12 oz standard can or a 12 oz Slim Can™ with a 202 neck configuration.

The cooling structure 107 also may be formed by compressive molding in the manner prescribed above and then broken up into granular form so that it can be poured into the outer shell container 100 to form the apparatus 10.

Another method of forming the cooling structure 107 is by using endothermic salts E and carbonates and adding one of Polytetrafluoroethylene (PTFE) fibers and activated carbon, in combination with organic salts such as one or more of Sodium Chloride, Potassium Chloride, and in some cases with Sodium Bicarbonate to form the cooling structure 107. The PTFE fibers can be replaced with activated carbon, and fullerene nanotubes, however, PTFE fibers are more effective in application and are preferred for cleanliness. The use of PTFE and other media that can absorb $CO_2$ to make the cooling structure 107 semi porous for storing gases and also for providing a porous substrate for water, the water easily dissolves the cooling structure 107 by opening the pores formed by compression to release trapped dry gas DG. The mixtures of urea with the PTFE fibers and salts and carbonates can be varied to various proportions as shown as an example in the table below.

| Urea range | PTFE, activated carbon, range | Salt or carbonate range |
|---|---|---|
| 60%-80% | 2% | 38%-18% |

The mixture is generally heated in the mold 300 or extrusion cavity to a temperature of 271.4° F. at which point the urea melts to a clear liquid without decomposition. $CO_2$ is introduced under a pressure of about 820 psi and greater, and even to supercritical pressures over the extrusion or mold cavity 301. The dry gas DG is infused into the mold cavity 301 to mix with the molten urea U by slowly bubbling the dry gas DG through the molten urea U as micro bubbles through the mold cavity 301 using a slow release control valve. The bubbles should be about 0.01" in diameter and, as such, holes made through the mold cavity 301 can be used to bubble a gas for example, such as $CO_2$. Preferably, the range of diameters of the holes of dry gas DG are as small as 10 microns to 200 microns, and as such they may be laser perforated through the mold 300, if desired. It is important that the mold cavity 301 holes be small enough not to allow the passage of molten urea U and endothermic salts E through them, but can allow the free passage of dry gas DG. Heating of the urea can also be achieved by just introducing the dry DG gas under pressure to generate a heating of the gas. Thus, dry $CO_2$ for example can be pressurized into the molten urea U mixture through the mold cavity 301 to generate the heat required without heaters. A cooling coil (not shown) may be used to pass cooling media such as cooled air, cooled water, and a cryogenic liquid through the mold cavity 301 to rapidly cool the urea and encapsulate the dry gas DG inside PTFE fibers and activated carbon granules as a sorbent. Urea U has a density 1.32 g/cc while PTFE has a density of 2.2 g/cc. at 271.4° F., the density of liquid $CO_2$ is about 0.76 g/cc. Thus, $CO_2$ is the lightest compound of the mixture and will tend to migrate in a vertical, upward direction through the mixture when introduced at the lowest point of the mold cavity 301 where the concentration of PTFE fibers is maximum due to their higher densities.

It is known that PTFE fibers and activated carbon encapsulate liquid $CO_2$ at a molecular level. If left by themselves, however, the $CO_2$ will eventually migrate through their pores and dissipate to Lo atmosphere, achieving very little storage. PTFE and activated carbon hollow fibers have facilitated $CO_2$ capture in other applications and their affinity to repel water makes them attractive in such $CO_2$ storage applications, where water vapor otherwise tends to fill the pores of other storage medium fibers in place of the $CO_2$. It is thus important that the dry gas DG, such as $CO_2$, be dried to a low dew point to avoid storing water in such matrices. Otherwise the storage capacity of the cooling structure 107 will be less than 10% of its available storage capacity at room temperature and normal atmospheric humidity of 50%. A random orientation of the micro PTFE fibers facilitates and allows the dry gas DG to easily interact and be trapped within the PTFE fibers as it migrates through the cooling structure 107. Thus the pores of the PTFE fibers and the urea U in the cooling structure 107 form crystalline blocked fiber cores encapsulating dry gas DG such as $CO_2$, as the cooling structure 107 cools and crystalizes around the fibers. The dry gas DG is substantially dried to a low dew point by removing water vapor from it. Dry gas DG does not mean non-liquefied $CO_2$, and one familiar with the term will know that dry $CO_2$, for example, can be liquefied but contains little or no water. The dry gas DG is substantially dried by flowing it through a desiccant bed to remove as much water as possible, and in this case, the dry gas DG is passed through a desiccant bed of silica crystals repeatedly and over a period of time to remove all moisture. Standard beverage plants and several factories use substantially dry $CO_2$ for carbonation of soda and beers. Water can reduce the capacity to store $CO_2$ in such structures, and thus the removal of as much water as possible helps achieve the aims of the invention. Further, the dry gas DG is needed to effectuate further cooling by absorption of water and humidification of the gas during operation of the apparatus 10.

Studies by the inventor show that when the ends of a tube holding liquefied substantially dry $CO_2$ are plugged with recrystallized molten urea U, the solidified crystals are capable of withstanding the critical pressures of the liquefied dry gas DG, even at large diameters of blockage. When the Urea is dissolved, some of the dry gas DG that has migrated into the urea U is also released with endothermic cooling. This property of urea is adopted to PTFE fibers, which can also store liquefied $CO_2$ when under pressure. The problem of dry gas DG storage lies in the further migration of the gas to atmosphere as time passes. This problem can be solved by encapsulating the dry gas DG using PTFE fibers trapped inside recrystallized urea U, forming bounded containments. Thus, extruding or molding a mixture of molten urea U, PTFE, and endothermic salts E with a dry gas DG such as $CO_2$ and then recrystallizing the urea U rapidly in a mold cavity 301 greatly facilitates dry gas DG capture, entrapping the dry gas DG for long term use.

The purpose of the endothermic salts E is to rapidly disintegrate the cooling structure 107 as they dissolve in humidification liquid HL forming cavities and pores which allow easy access for more water molecules to enter the cooling structure 107. The endothermic salts E may not be necessary if the disintegration of the urea U can occur quickly. Advantageously, the endothermic salts E can be chosen to also dissolve endothermically, allowing further cooling effects to be achieved in addition to the cooling effect effectuated by dissolving Urea U in water. The cooling structure 107 can thus be formed in this manner in any desired shape to be used to cool the apparatus 10.

Advantageously, the cooling structure 107 can be made in the form of longitudinal segments of a cylinder as semi-flexible thick membranes that can be wrapped and placed into the outer shell container 100, to expand and abut outer shell container inner cylindrical wall 101 and to surround the inner beverage container cylindrical wall 202 outer surface. It is also possible to mold form the cooling structure 107 by pouring its molten state on a fibrous open-celled sheet material such as a porous foam or a highly absorbent paper tissue to allow it to be flexible and contiguous.

To assemble the apparatus 10 according to the first embodiment, the cooling structure 107 is first formed and inserted into the outer shell container 100 to sit on its inner dome. If formed as a to compression molded structure, the cooling structure 107 is simply inserted to sit on the outer shell container base dome 103. If formed as a granular structure, the cooling structure 107 is simple poured onto the outer shell container base dome 103.

In both cases, a very thin compressible wax layer is then poured to form a compressible barrier structure 128 that fluidly seals over the surface of the cooling structure 107. Humidification liquid HL is then poured into the outer shell container 100 as to sit above the compressible barrier structure 128 and fill the annular radial space R between the containers and above the cooling structure 107. As shown in FIGS. 3-6, an indented annular groove 122 may be made on the outer shell container 100 to reduce the amount of material used to form the compressible barrier structure 128. This facilitates recycling since the compressible barrier structure 128 may be reduced to a just a sealing film or completely eliminated by making indented annular groove 122 seal against inner beverage container outer cylindrical wall 202.

A vapor passageway 110, comprising a small hole of dimensions between $1/8^{th}$ of an inch to ½ an inch in diameter is made through the outer shell container cylindrical wall 111, preferably at the highest possible location on the outer shell container cylindrical wall 111. The vapor passageway 110 can also be made by laser perforation to create several small holes in place of a single large hole. The purpose of the vapor passage way 110 is to allow effluent dry gas DG, preferably $CO_2$, to exit the apparatus 10 from the humidification liquid chamber HLC to atmosphere. The vapor passageway 110 may not be necessary if the volume of dry gas DG that is stored in the cooling structure 107 will not generate a pressure greater than 1 psi.

As noted above, a preferred location for the vapor passageway 110 is at about the 1" from the outer shell container open rim 106. In other cases, the vapor passageway 110 may also be placed on the topmost possible location of the inner beverage container outer cylindrical wall 111 and through the inner beverage container inner cylindrical wall 202. This also allows the dry gas DG to pass through inner beverage container cylindrical wall 202 through the inner beverage container cylindrical wall 201 inner surface and then through the beverage container opening means 116.

Preferably the vapor passageway 110 is placed in the outer shell container 100 to avoid any possibility of contamination between the beverage B in the inner beverage container 200 with the L 5 cooling structure 107. Yet again in other instances, the vapor passageway 110 can be made through the Inner beverage container 200 and additionally through the beverage container opening means 116. The vapor passageway 110 communicates fluidly between atmosphere and the humidification liquid chamber HLC formed by the annular radial space R between the two containers. Thus, advantageously, the vapor passageway 110 can be made on the outer shell container 100 to allow the humidification liquid chamber HLC to communicate with the atmosphere. The vapor passageway 110 can also be made through the inner beverage container 200 to allow communication between the humidification liquid chamber HLC and atmosphere through either the beverage container opening means 116 or alternatively through a vapor passageway 110 made directly through the beverage container lid 113.

A filtration membrane 117 preferably made from a thin hydrophobic plastic disc of Polytetrafluoroethylene (PTFE) with pore sizes such as 0.05 um, 0.10 um, 0.22 um, 0.45 um, 1 um, 2 um, 3 um, 5 um, is attached by a strong hydrophobic and water compatible adhesive to cover over the vapor passageway 110 either on the inside or the outside surface surrounding the vapor passageway 110. Preferably, the adhesive is placed on the cylindrical portion of the filtration membrane 117, not covering the vapor passageway 110. The filtration membrane 117 also may be welded onto any of the container walls by thermal or ultrasonic welding to cover the vapor passageways 110. The attached filtration membrane 117 must be able to withstand pressures greater than carbonation pressures of about 60 psi. In the case when the vapor passageway 110 is placed on the inner beverage container cylindrical wall 115, the filtration membrane 117 must be large enough to allow the free flow of dry gas DG through its structure without stressing the walls of the inner beverage container 200 with back pressure, otherwise back pressure may crush the walls of the inner beverage container 200. A multiplicity of vapor passageways 110 may also be perforated through both the inner beverage container 200, the outer shell container 100, and the beverage container lid 113 to reduce the back pressure of dry gas DG and prevent it from collapsing the inner beverage container 200 walls.

Preferably the filtration membrane 117 is a thin membrane of a thickness less than 5 mills, and about 20 mm to 50 mm in diameter, and has a burst pressure of above 80 psi and can also adequately withstands the pressures that are generated when the apparatus 10 is in operation, releasing $CO_2$ to atmosphere.

The filtration membrane 117 is hydrophobic and thus does not allow humidification liquid HL liquids to pass through its pores, but will allow dry gas DG to pass through its pores. The vapor passageway 110 affords a means of passing dry gas DG through a filtration membrane 117 from the humidification liquid chamber HLC to atmosphere.

The next step in the assembly and manufacturing process of the first embodiment is to pour a prescribed amount of humidification liquid HL, preferably water, into the outer shell container 100. The amount of humidification liquid HL must be enough to just fill the annular radial space R between the containers 100 and 200. Then, the next step in assembling the first embodiment of apparatus 10 is to slowly insert the inner beverage container 200 through the outer shell container open rim 106 until the inner beverage container sealing flange 207 rests on the outer shell container sealing flange 207*a*. During this process, gases inside the empty cylindrical space A forming the humidification liquid chamber HLC will build up pressure and rise and pass through the vapor passageway 110 and through Lo the filtration membrane 117 to atmosphere as the humidification liquid HL is displaced by the inner beverage container 200 to rise inside the cylindrical space A between the containers until it substantially fills the humidification liquid chamber HLC.

A protective sealing membrane 120 in the form of thin membrane of plastic or paper with glue lining on its edge may be attached firmly to cover and protect the filtration membrane 117 from the outside environment. The sealing membrane 120 is not essential but accords protection of the humidification liquid chamber HLC from atmospheric pressure changes and dirt. The protective sealing membrane 120 must be attached so that it can be either be dislodged or can be ruptured by a slight pressure that is greater than carbonation pressure, preferably above 50 psi of pressure. Thus, advantageously, the sealing membrane 120 must be designed to form a seal over the filtration membrane 117 during normal storage of a carbonated beverage B without rupturing. Preferably the sealing membrane 120 is welded by thermal or ultrasonic welding unto the surfaces of the containers 100 and 200 over the vapor passageway 110. The sealing membrane 120 must be attached to withstand pressures greater than carbonation but should be rupturable when the pressure exceeds the carbonation pressure of the beverage B being cooled.

The next step is just filling a beverage B into the inner beverage container 200 through inner beverage container open rim 206 using conventional beverage filling machines. The next step is to jointly seam and seal both the inner beverage container sealing flange 207 and the outer shell container sealing flange 207*b* simultaneously to the beverage container lid flange 207*c*. This provides a seal for the beverage B product inside the inner beverage container 200, and also provides a seal for the dry gas chamber DGC and humidification liquid chamber HLC simultaneously. If the outer shell container 100 is required to be pressurized, the filtration membrane 117 may be placed over a vapor passageway 110 made on the inner beverage container 200 and a sealing membrane 120 may be placed over any filtration membrane 117 that is on the beverage container lid 113. Alternatively, it may be placed on the outer shell container cylindrical wall 111 at an appropriate location at the highest possible location. This allows carbonation pressure from the beverage B to enter into the outer shell container 100 and pressurize its walls.

Experiments by the inventor show that the co-seaming of the two flanges as described above provides an adequate seal for the purposes of the invention. However, it is useful to make sure that there is enough compression of the three sealing flanges to form an adequate seal that can withstand carbonation pressure. The vapor passageway 110 made on the inner beverage container 200 ensures rapid equilibration of pressure between the carbonated beverage B and the volume cylindrical space A, so that the inner beverage container 200 bears little or no pressure related stresses.

A means of activating the cooling process for the first embodiment requires a vapor passage way 110 through the inner beverage container outer cylindrical wall 202, through the inner beverage container inner cylindrical wall 201, and the beverage container lid 113.

Apparatus 10 is activated by simply depressing the wall of the outer shell container 100 to compress the compressible barrier 128 formed by the wax ring and deform it from a sealing configuration to a non-sealing configuration.

In the first embodiment, the humidification liquid HL in the cylindrical space A is released by gravity to contact the cooling structure 107 below it as it flows through the deformed compressible barrier 128. Simple agitation by swirling or shaking can ensure that the humidification liquid HL contacts the cooling structure 107 and the process will continue as pressure builds up inside the outer shell container 100 and ruptures the deformed compressible barrier 128. The pressure loss also causes the deformed compressible barrier 128 to break and deform further as the humidification liquid HL becomes carbonated and pushes the deformed compressible barrier 128 to release gas. This way, after the apparatus 10 is activated, the pressurized dry gas DG that is generated will pass through a vapor passageway 110 through the inner beverage container 200 and thus through a filtration membrane 117, and then, through a vapor passageway 110 on the beverage container lid 113. The pressure of the existing gases will be higher than carbonation pressure and thus will dislodge the protective sealing membrane 120 to exit to atmosphere. It is important that the rate of flow of gases through the filtration membranes 117 be selected to match each other. This way, no back pressures are generated during the process that may compressibly crush the inner beverage container 200.

Method of Manufacture of the Second Embodiment of the Invention

Figure 3:
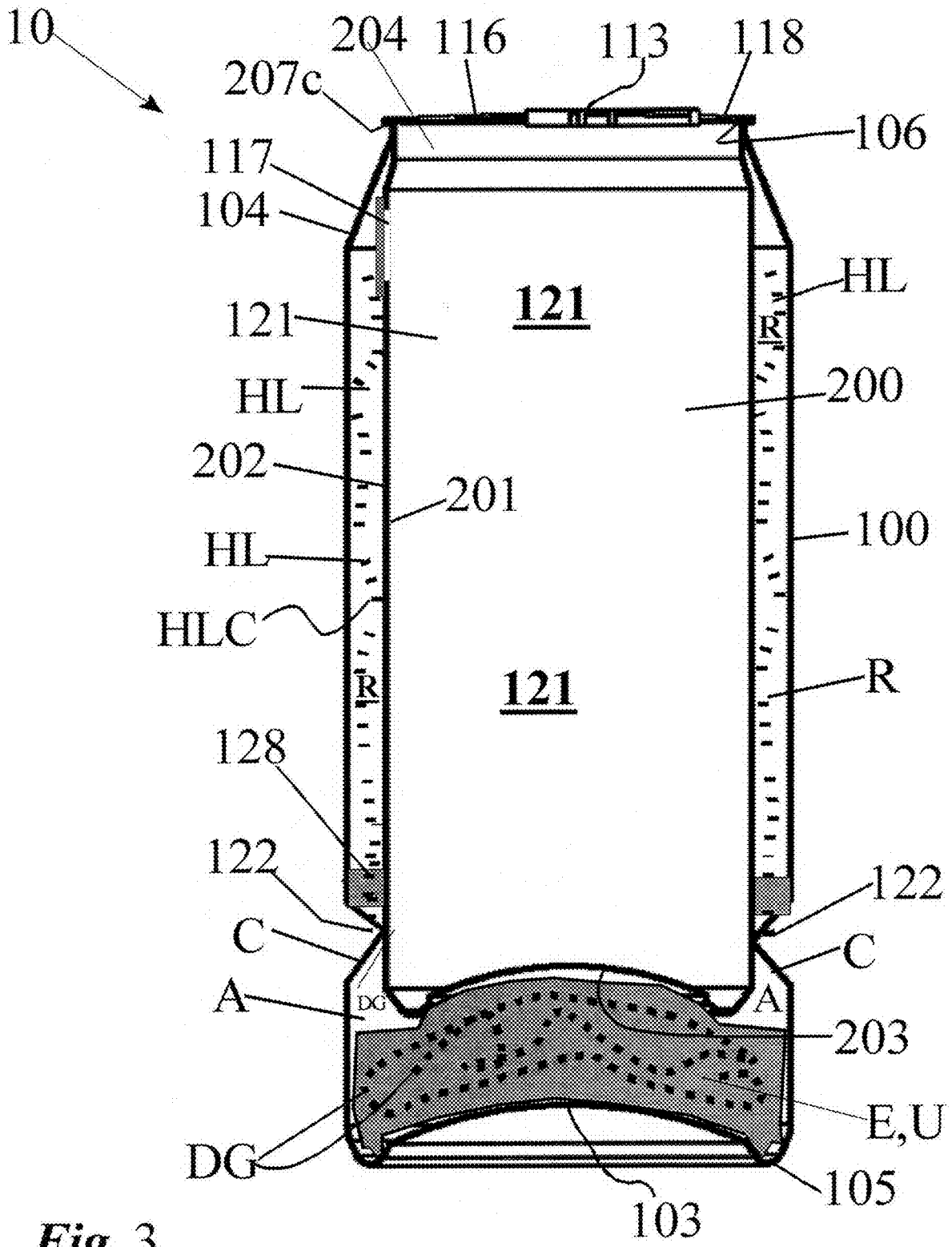
FIG. 3 shows the apparatus according to the second embodiment of the invention. An outer shell container is shown as with an inwardly rolled portion forming a barrier between the humidification liquid and the dry gas chamber against the inner beverage container. A humidification liquid chamber containing a humidification liquid is shown as a concentric space between the two containers. The cooling structure is shown in the dry gas chamber in the space between the base of the inner beverage container and the base of the outer shell container.
Figure 4:
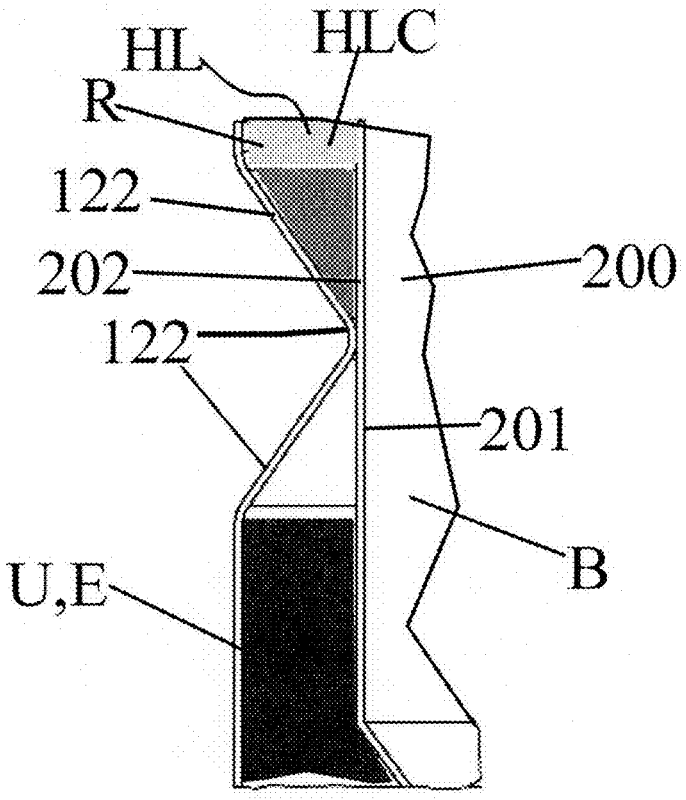
FIG. 4 shows a partial cutaway section of the interconnection structure with the compressible barrier filling a portion of the interconnection structure that connects to the humidification liquid chamber according to the first embodiment of the invention. The configuration shows the apparatus before the beverage container is opened.
Figure 5:
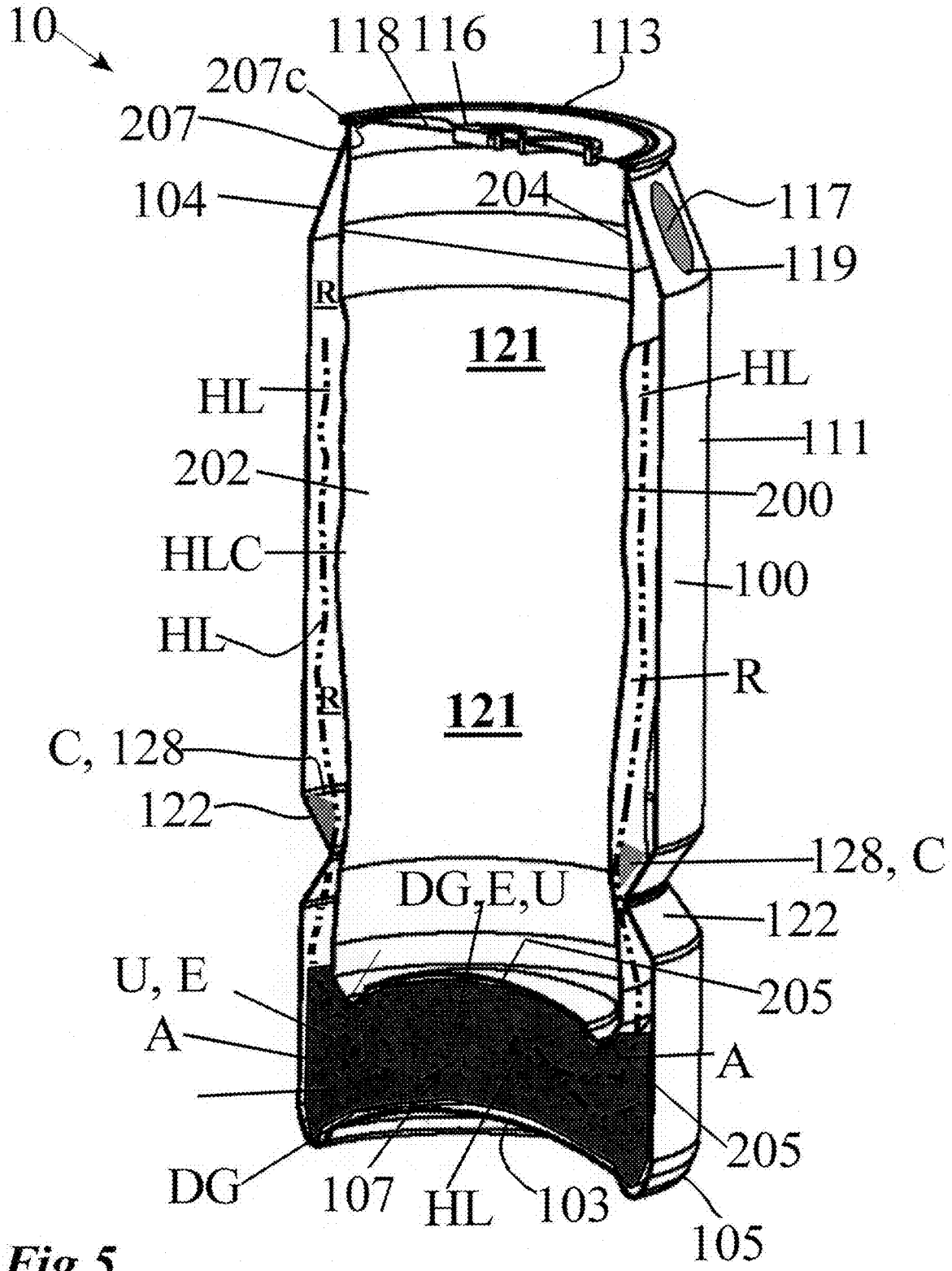
FIG. 5 shows a cross section of apparatus after opening the lid opening means with the loss of pressure of the inner beverage container causing the inner beverage container to slightly deform by compression from the pressure in the dry gas chamber causing the passage of humidification liquid into dry gas chamber.
Figure 6:
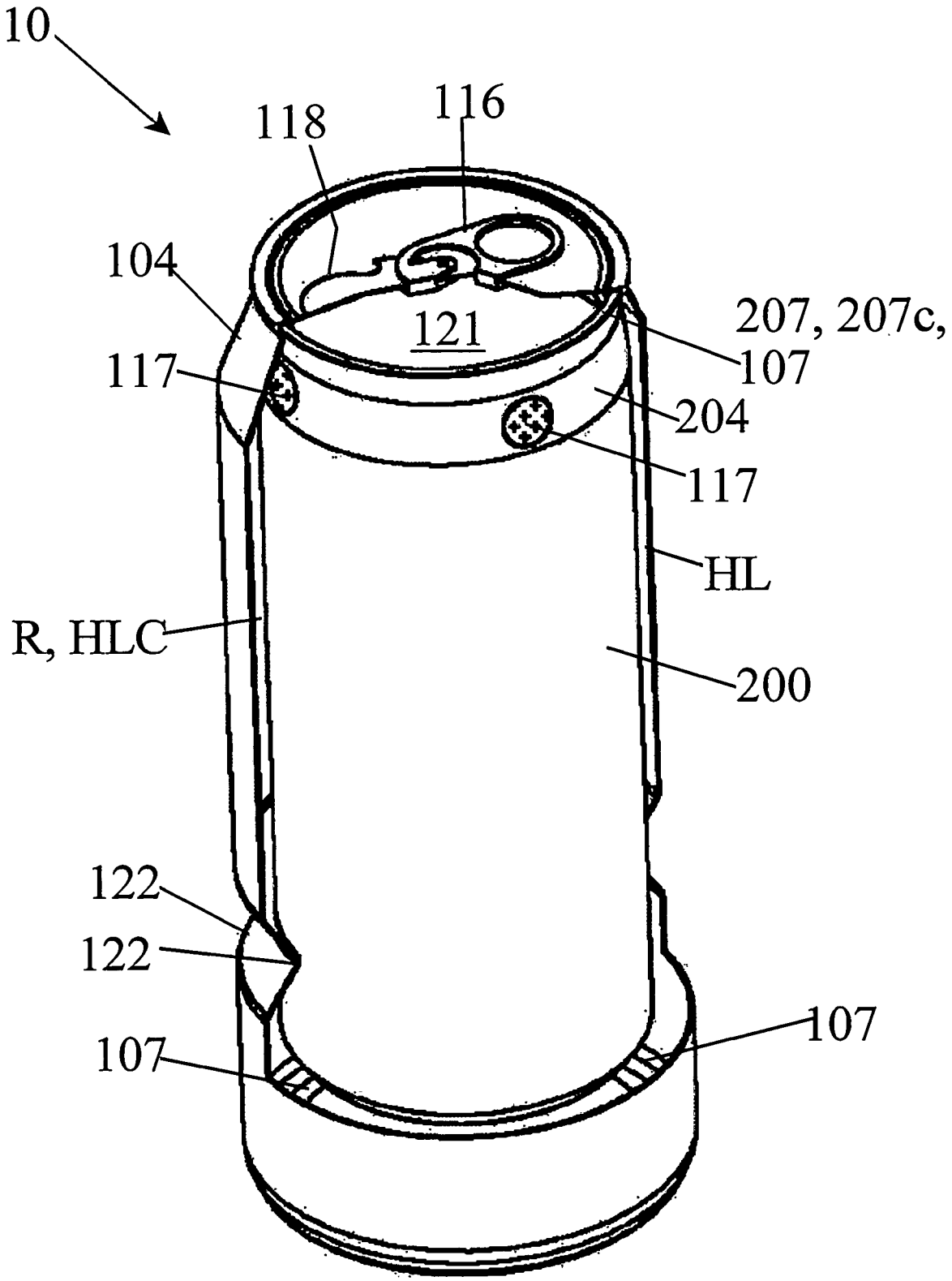
FIG. 6 shows the first embodiment of the invention with one or more the filtration membranes attached to cover a dry gas passageway through the cylindrical wall of the inner beverage container.
Figure 7:
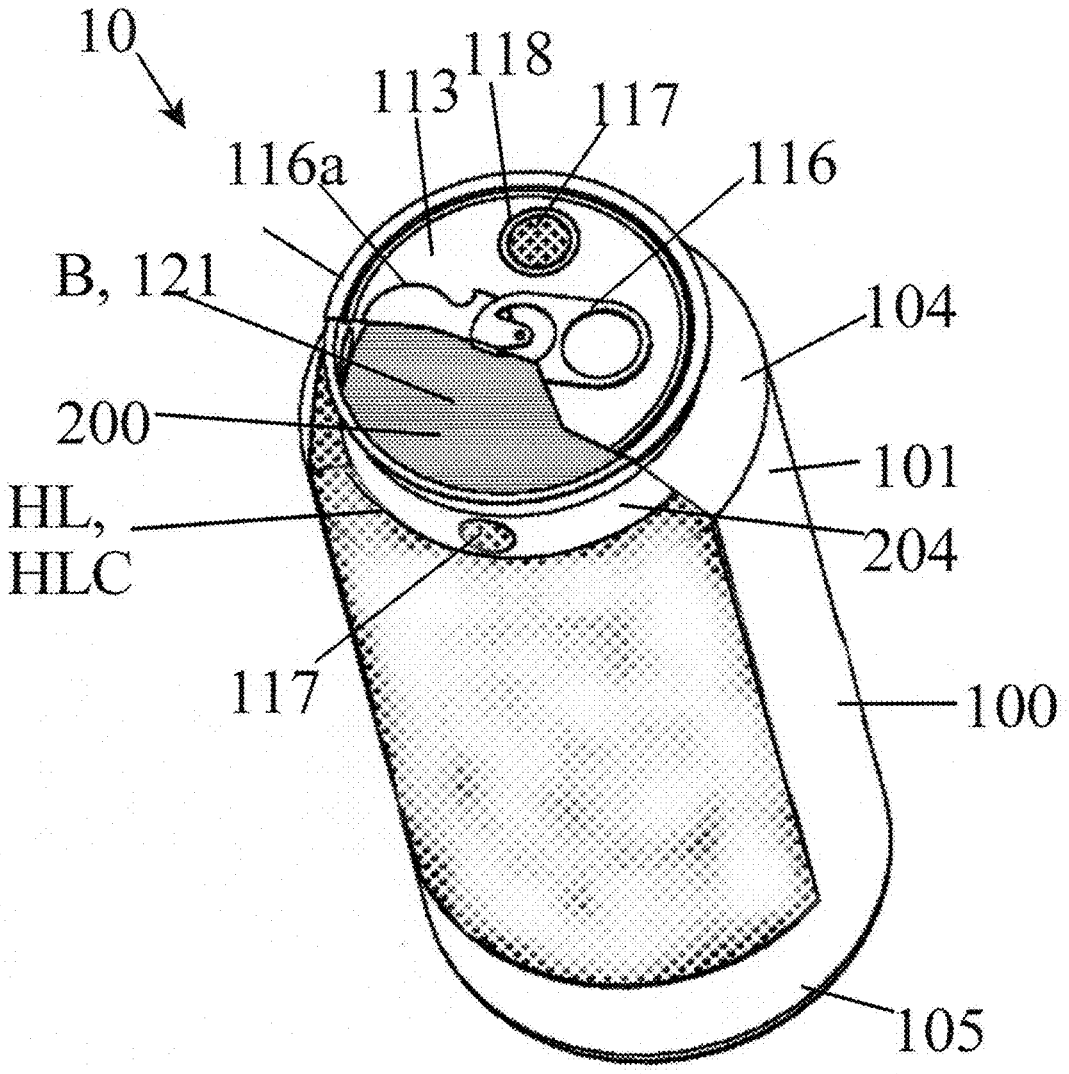
FIG. 7 shows a partial cut away view of the outer shell container according to the second embodiment of the present invention, with the dry gas chamber filled with a cooling structure in the form of a cylindrical structure surrounding the inner beverage container. Filtration membranes are shown attached to the inner beverage container and also on the beverage container lid.
Figure 8:
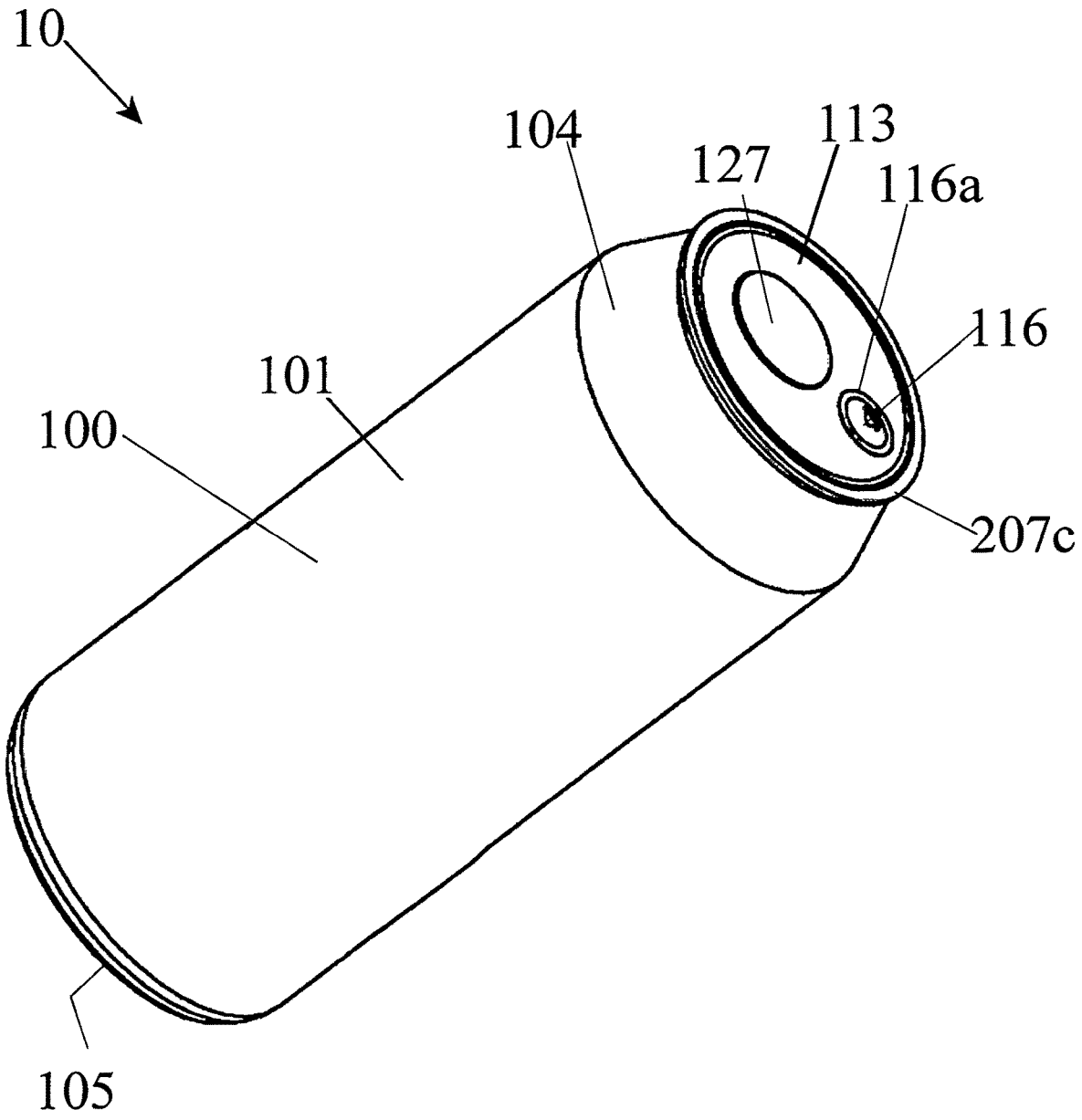
FIG. 8 shows a disc pressure release opening means for the apparatus that consists of a disc sealing an opening on the lid. The high pressure of the carbonation prevents easy opening of the pressure released opening means to prevent opening of the inner beverage container and thus prevent a sudden loss of carbonation pressure that can cause the collapse of the inner beverage container walls.
Figure 9:
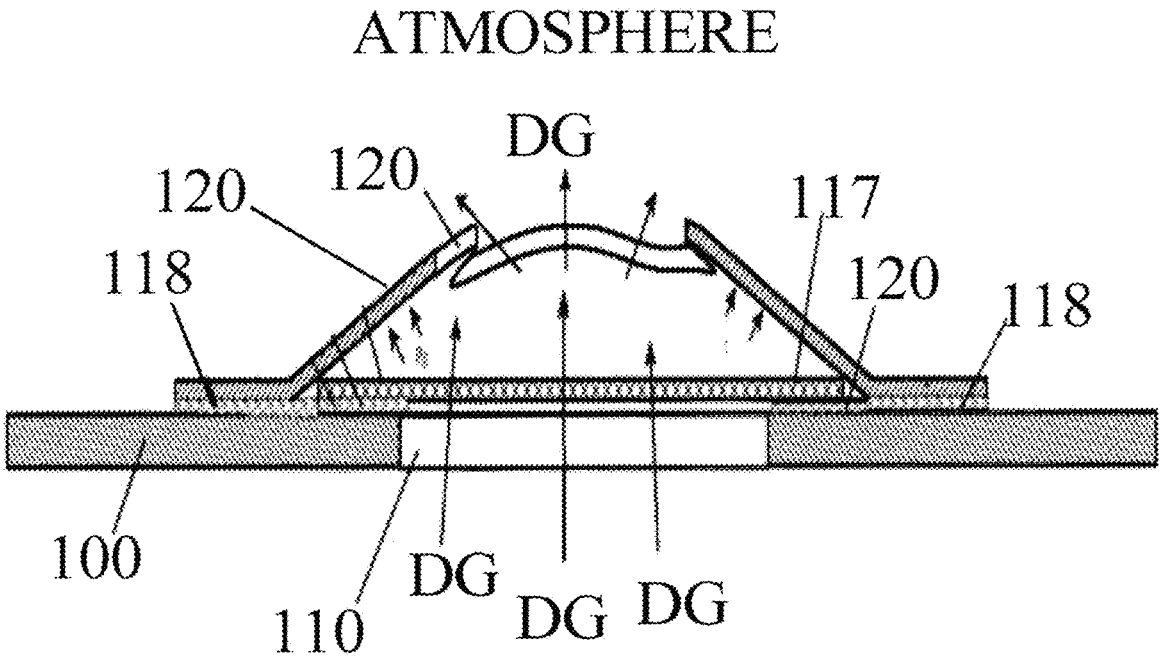
FIG. 9 shows a partial cross-sectional view of the filtration membrane covered by a sealing membrane that has been ruptured by dry gas pressure. The sealing membrane can also just be dislodged from a sealing position over the filtration membrane to allow dry gas to escape to atmosphere.
Figure 10:
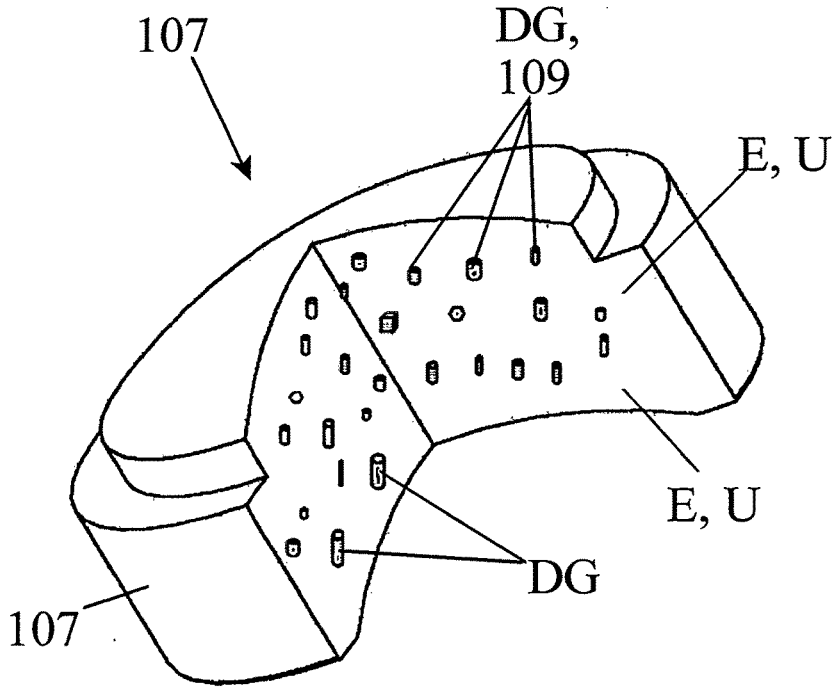
FIG. 10 shows a cross section of the cooling structure with the dry gas trapped in the crystalline structure by compression molding.

FIG. 3 shows a second embodiment of the invention. As before, the second embodiment of the invention requires two conventional beverage containers with matched sizes to serve the purposes of an outer shell container 100 and an inner beverage container 200 that form part of apparatus 10. The outer shell container 100 and the inner beverage container 200 are chosen such that the outer diameter of the inner beverage container 200 fits snugly through the outer shell container open rim 106 which has a larger diameter than the inner beverage container outer cylindrical wall 202. The inner beverage container 200 is chosen to have a height that is less than the outer shell container 100.

The gap between the height of the outer shell container base dome 103 and the height of the inner beverage container base dome 203 forms a cylindrical space A between them. The gap between the diameter of the outer shell container cylindrical wall 111 and the diameter of the inner beverage container cylindrical wall 201 forms an annular radial space R between them. The cylindrical space A forms humidification liquid chamber HLC which will hold a humidification liquid HL, and the annular radial space R forms a dry gas chamber DGC that will hold a cooling structure 107 impregnated with a dry gas DG.

LO In the second embodiment, the annular radial space R between the two containers now forms a dry gas chamber DGC as opposed to a humidification liquid chamber HLC, and the cylindrical space A forms humidification liquid chamber HLC that will hold a humidification liquid HL. As such, the roles of the dry gas chamber DGC and the humidification liquid chamber HLC have been reversed as a counter example to the first embodiment.

The first step in making the second embodiment is to form a vapor passageway 110 at the center of the outer shell container base dome 103. The vapor passageway 110 communicates fluidly between atmosphere and the cylindrical space A between the two containers. Thus, advantageously, the vapor passageway 110 can be made through the outer shell container cylindrical wall 102 and through the outer shell container base dome 103 to allow the fluid communicate between the cylindrical space A with atmosphere.

As before, a filtration membrane 117 is placed over the vapor passageway 110. Preferably the filtration membrane 117 is a thin membrane of thickness less than 5 mills, and about 20 mm to 50 mm in diameter, and has a burst pressure of above 50 psi and can also adequately withstand the pressures that are generated when the apparatus 10 is in operation releasing $CO_2$ to atmosphere.

The next step in assembling the second embodiment is to flood the outer shell container 100 with a extremely dry gas DG such as $CO_2$ or Dimethyl ether. The dry gas DG need not be under pressure. This displaces any air that may be inside the outer shell container 100.

In this embodiment, the cooling structure 107 can be made as one or more segments of a cylinder that fits into the annular radial space R between the containers 100 and 200. If made as a cylinder, the shape of the cooling structure 107 is preferably a split cylinder whose cylindrical wall is cut along its longitudinal axis to allow it to be squeezed to a smaller diameter that can pass through the outer shell container open rim 106 and then expanded to attach itself by friction to shell container Lo cylindrical wall 101 inner surface within the annular radial space R. The cooling structure 107 also may be made in segments that can easily be inserted through the outer shell container open rim 106 to attach to outer shell container cylindrical wall 101 inner surface.

A preferred way of making the cooling structure 107 for this embodiment is by compression molding it into the cylindrical portions in a mold as described above. In such a case, the mixture of urea U, endothermic salts E and some carbonates is compressed to a high tonnage by a press capable of pressures of about 20 tons to 50 tons of force, and then heated in a mold cavity that is pressurized with dry gas DG to form cylindrical segments. The cooling structure 107 mixture will heat up as it is compressed to form a contiguous crystalline structure into the desired cylindrical segment shapes as described earlier. This process can be very effective for mass production and requires at least a 20-ton press for the "cakes" to be stable in very much the same manner as a tablet of medication is made. This method can also be used to form segmented cooling structure 107 sections that can be easily inserted into the outer shell container 100.

Yet another effective way of making the cooling structure 107 is to heat the cooling structure 107 with sorbents, (PTFE, and or activate carbon), salts and carbonates and to extrude the molten mixture directly unto the outer shell container inner cylindrical wall 101 as the outer shell container 100 is spun on its axis to rotate preferably in a horizontal axis of symmetry. The cooling structure 107 will then solidify as it cools to form a solid cylindrical layer stuck on the outer shell container inner cylindrical wall 101 in the annular radial space R. This process provides a simple and fast method of mass manufacturing the cooling structure 107 while achieving insertion into the outer shell container 100 directly. Care must be taken to allow the flow of the molten cooling structure 107 to form an even cylinder that has a diameter just slightly larger than that of the inner beverage container 200 so that the inner beverage container 200 can slide freely into the outer shell container 100.

Humidification liquid HL is first poured into the outer shell container 100 to sit and fill the cylindrical space A between the outer shell container base dome 103 and the inner beverage container base dome 203. The next step in forming the apparatus 10 according to the second embodiment is to pour a thin layer of molten wax into the outer shell container 100 to float and cover over and seal the humidification liquid HL as it dries.

The vapor passageway 110 can also be made by laser perforation to create several small holes in place of a single large hole. The purpose of the vapor passageway 110 is to allow effluent dry gas DG, preferable, $CO_2$, to exit the apparatus 10 from the dry gas chamber DGC to atmosphere. The vapor passageway 110 may not be necessary if the volume of dry gas DG stored in the cooling structure 107 will not generate much pressure greater than 1 psi.

As before, the next step is to slowly insert the inner beverage container 200 through the outer shell container open rim 106 until inner beverage container sealing flange 207 rests snugly on the outer shell container sealing flange 207*a*. During this process, dry gas DG inside the cylindrical space A that forms the dry gas chamber DGC, builds up pressure as the dry gas DG that was flooded into the outer shell container 100 is displaced by the inner beverage container 200. The excess dry gas DG passes through the vapor passageway 110 and through the filtration membrane 117 to atmosphere.

As before, a protective sealing membrane is attached firmly to cover and protect the filtration membrane 117 from the outside environment. The sealing membrane 120 is not essential but accords protection of the dry gas chamber DGC from atmospheric pressure changes and dirt. The protective sealing membrane 120 must be attached so that it can be either dislodged or can be ruptured by pressure greater than atmospheric pressure. Thus, the sealing membrane 120 must be designed to form a seal over the filtration membrane 117 during normal storage of a carbonated beverage B without rupturing. Preferably the sealing membrane 120 is welded by thermal or ultrasonic welding unto the to surfaces of the containers over the vapor passageways 110.

The next step is just filling a beverage B into the inner beverage container 200 using conventional beverage filling machines and seaming a beverage container lid 113 to co-seam and seal both the inner beverage container sealing flange 207, and the outer shell container sealing flange 207*a* to the beverage container lid flange 207*c* simultaneously. This provides a seal for the beverage product B inside the inner beverage container 200, and also provides a seal for the dry gas chamber DGC and humidification liquid chamber HLC. If the outer shell container 100 is required to be pressurized, the filtration membrane 117 may be placed over a vapor passageway 110 made on the inner beverage container 200 and a sealing membrane 120 may be placed over any filtration membrane 117 that is on the beverage container lid 113 or the outer shell container 100. This allows carbonation pressure from the beverage B to enter into the outer shell container 100 through the inner beverage container to pressurize the outer shell container 100.

Advantageously, in all embodiments, the inner beverage container sealing flange 207 may be softened for easy seaming by heating it and quenching with water. This allows it to easily stretch over the outer shell container sealing flange 207*a* and the beverage container lid flange 207*c* for the co-seaming operation.

In particular cases for both the first and the second embodiments, when the apparatus must not be opened for consumption prior to cooling, a beverage container lid made with a finger depressible sealing disc can be used instead of the conventional tab on the beverage container lid. Such lids are readily available from Ball Container Corporation™ in the USA and from Crown Cork and Seal Corporation™. The Global Vent™ lid made by Crown Cork and Seal™ is an example of such a beverage container lid. The resealable twist and turn lid made by Rexam USA™ is another example of such a lid. These special lids have an opening that is sealed by a depressible disc. The surface area of the disc can be chosen so that when pressure builds up during cooling and the release of $CO_2$, the pressure acting on this area will generate a force that is enough to prevent the lid from being readily depressed by finger pressure F, until all the gases have exited the outer shell container through the vapor passageway and through the filtration membrane to atmosphere, allowing the pressure to fall to a pressure that will exert a minimal force that allows the disc to be depressed by finger pressure F. The LS apparatus is now ready for use.

To activate the cooling process, the apparatus 10 is turned upside down with the base dome at the top. The apparatus is activated by simply depressing the wall of the outer shell container 100 to compress the compressible barrier 128 formed by the wax ring and deform it from a sealing configuration. The humidification liquid HL in the cylindrical space A is released by gravity to contact the cooling structure 107 below it as it flows through the deformed compressible barrier 128. Simple agitation by swirling or shaking the can 10 ensures that the humidification liquid HL contacts the cooling structure 107, and the process will continue as pressure builds up inside the outer shell container 100 and ruptures the deformed compressible barrier 128. The pressure loss also causes the deformed compressible barrier 128 to break and deform further as the humidification liquid HL becomes carbonated and pushes the deformed compressible barrier 128 to release gas. This way, after the apparatus 10 is activated, the pressurized dry gas DG that is generated will pass through a vapor passageway 110 through the inner beverage container 200 and thus through a filtration membrane 117, and then, through a vapor passageway 110 on the beverage container 200. The pressure of the exiting gases will be higher than carbonation pressure and thus will dislodge the protective sealing membrane 120 to exit to atmosphere. It is important that the rate of flow of gases through the filtration membranes 117 be selected to match each other. This way, no back pressures are generated during the process that may compressibly crush the inner beverage container 200.

The cooling structure 107 is endothermically dissolved and the urea U that is dissolved allows the $CO_2$ trapped in the cooling structure 107 to expand and cool the beverage further, and the $CO_2$ further absorbs water as a dry gas DG and humidifies, effectuating cooling by phase change, evaporation and endothermic cooling. The apparatus 10 can now be left standing in its normal upright configuration and the foaming turbulence thus generated by the $CO_2$ will gradually allow the Ls humidification liquid HL to continuously disrupt and rupture the remaining compressible barrier 128 to release gas, allowing continuous contact between humidification liquid HL and the cooling structure 107, even in an upright position. The pressure of the gas rises, causing the sealing membrane 120 to rupture or become dislodged from the container and allowing only $CO_2$ gas to pass through the filtration membranes 117 to atmosphere. This effectuates cooling of the inner beverage container 200 as well as the outer shell container 100.

A second means of activating the cooling process is to simply open the beverage container opening means 116. This requires a vapor passageway 110 and a filtration membrane 117 to be placed either through the inner beverage container cylindrical wall 115 or through the outer shell container cylindrical wall 111. No harm is done if both vapor passages are made as stated earlier in the first activation means. When this is done, the pressure loss then causes inner beverage container 200 walls to momentary relax and the compressible barrier 128 formed by the wax is disrupted. Further agitation will ensure that the water contacts the cooling structure 107 as it disintegrates and falls into the humidification liquid HL. The cooling structure 107 is endothermically dissolved and the dry gas DG trapped in the cooling structure 107 expands and cools the humidification liquid HL further, and the dry gas DG further absorbs humidification liquid HL as a dry gas DG humidifies, effectuating cooling by phase change, evaporation and endothermic cooling. The dry gas DG can either exit through the vapor passageway 110 on the inner beverage container 200 or through the vapor passageway 110 on the outer shell container 100 and also through both vapor passageways 110. The apparatus can now be left standing on its normal upright configuration and the foaming turbulence thus generated by the $CO_2$ will gradually allow the water to continuously disrupt and rupture the remaining wax barrier structure, allowing continuous contact between water and the cooling structure, even in an upright position.

Method of Manufacture of the Third Embodiment of the Present Invention

As before, the third embodiment of the invention requires two conventional beverage containers with matched sizes to serve the purposes of an outer shell container 100 and an inner beverage container 200 that form part of apparatus 10. The outer shell container 100 and the inner beverage container 200 are chosen such that the outer diameter of the inner beverage container 200 fits snugly through the outer shell container open rim 106, which has a larger diameter than the inner beverage container cylindrical wall 202 outer surface. The inner beverage container 200 is chosen to have a height that is less than the outer shell container 100.

The gap between the height of the outer shell container base dome 103 and the height of the inner beverage container base dome 203 forms a cylindrical space A between them. The gap between the diameter of the outer shell container cylindrical wall 111 and the diameter of the inner beverage container cylindrical wall 201 forms an annular radial space R between them. The cylindrical space A forms humidification liquid chamber HLC which will hold a humidification liquid HL, and the annular radial space R forms a dry gas chamber DGC that will hold a cooling structure 107 impregnated with a dry gas DG.

Figure 12:
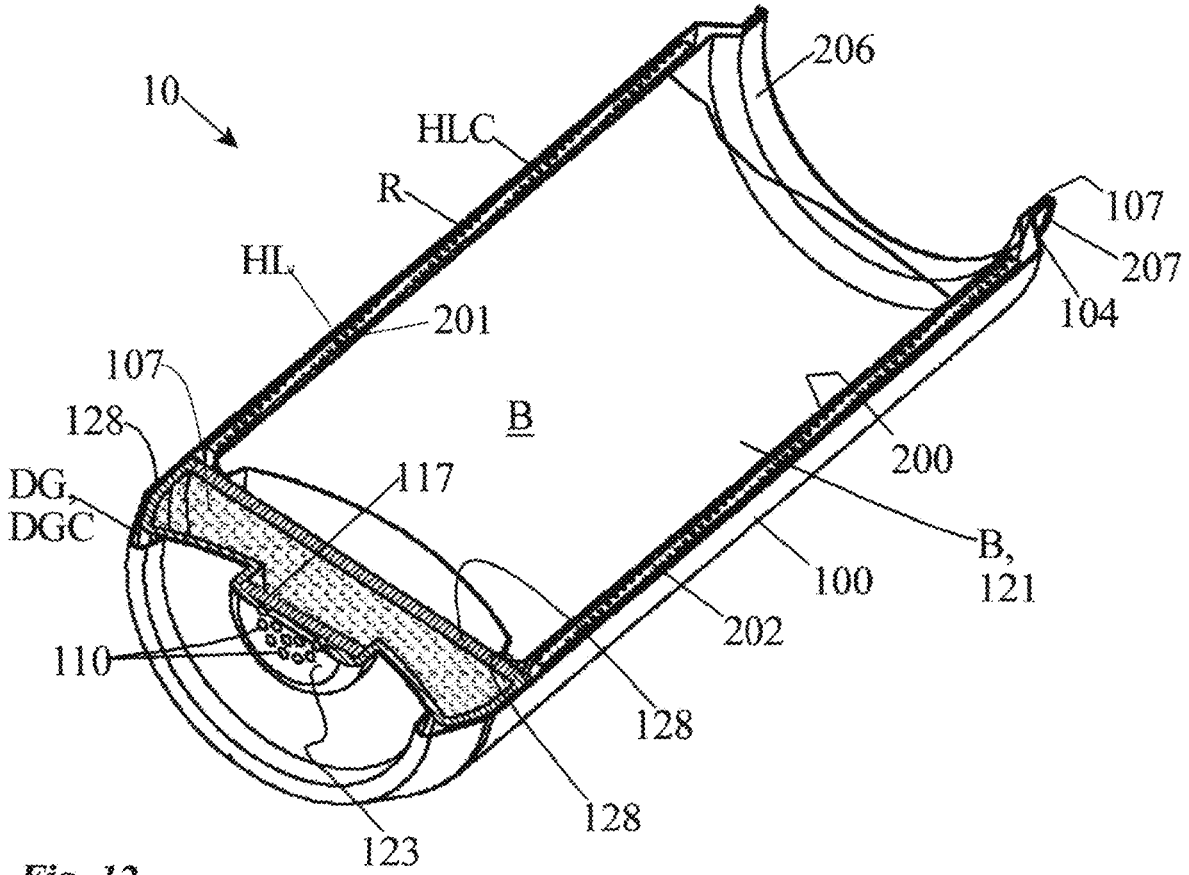
FIG. 12 shows an embodiment of the humidification liquid chamber as a separate container inside the apparatus.
Figure 13:
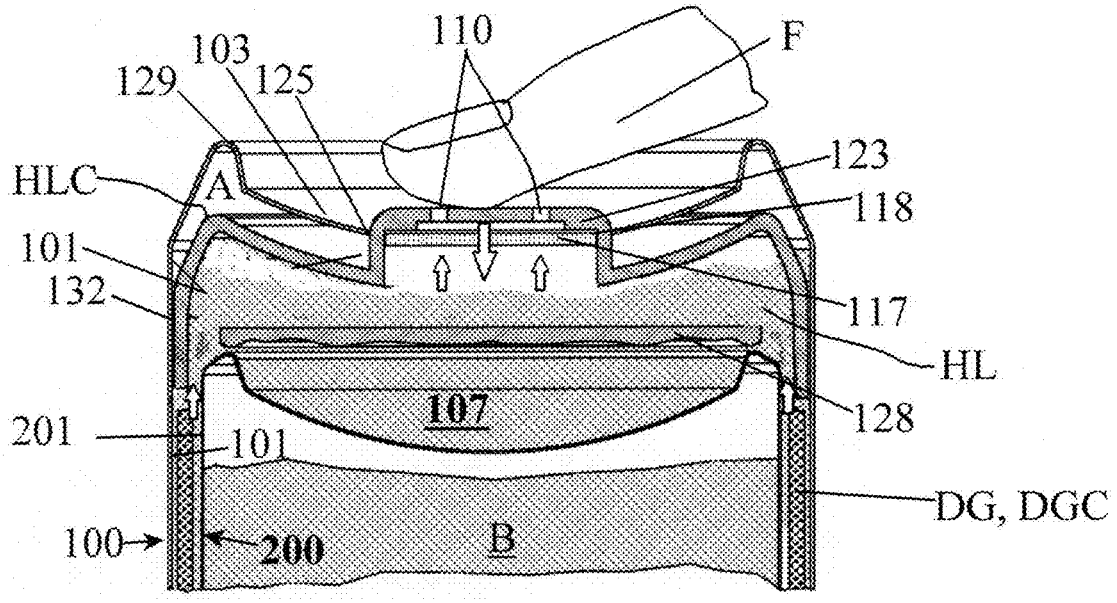
FIG. 13 shows finger pressure actuating the cooling process by pushing on the embodiment of the humidification liquid chamber in shown in FIG. 12 to break a compressible barrier such as a wax and a plastic and foil membrane to release humidification liquid into the dry gas chamber.
Figure 14:
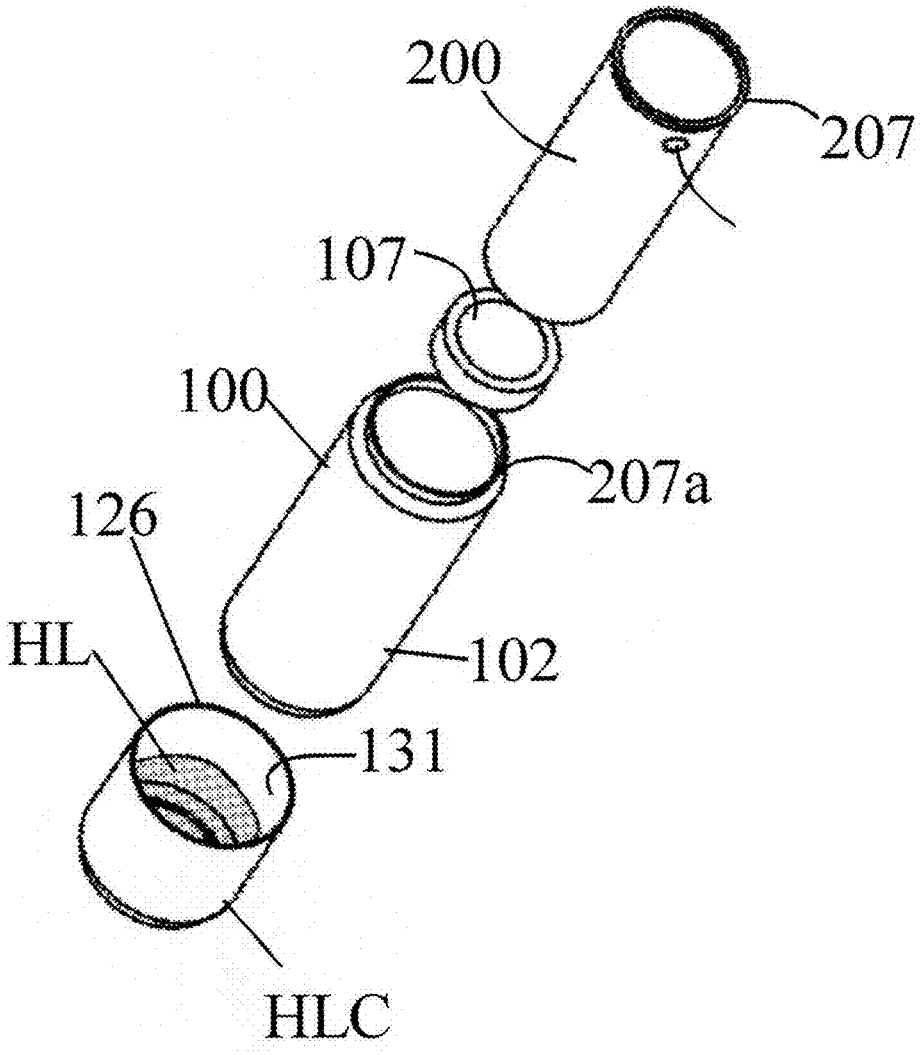
FIG. 14 shows an exploded view of the fourth embodiment of the invention with the cooling structure being inserted into the outer shell beverage container before the inner beverage container is slid into the outer shell container. A humidification liquid chamber is also shown holding humidification liquid and about to be slid over the base dome of the outer shell container to sealing slide along its outer cylindrical wall.
Figure 15:
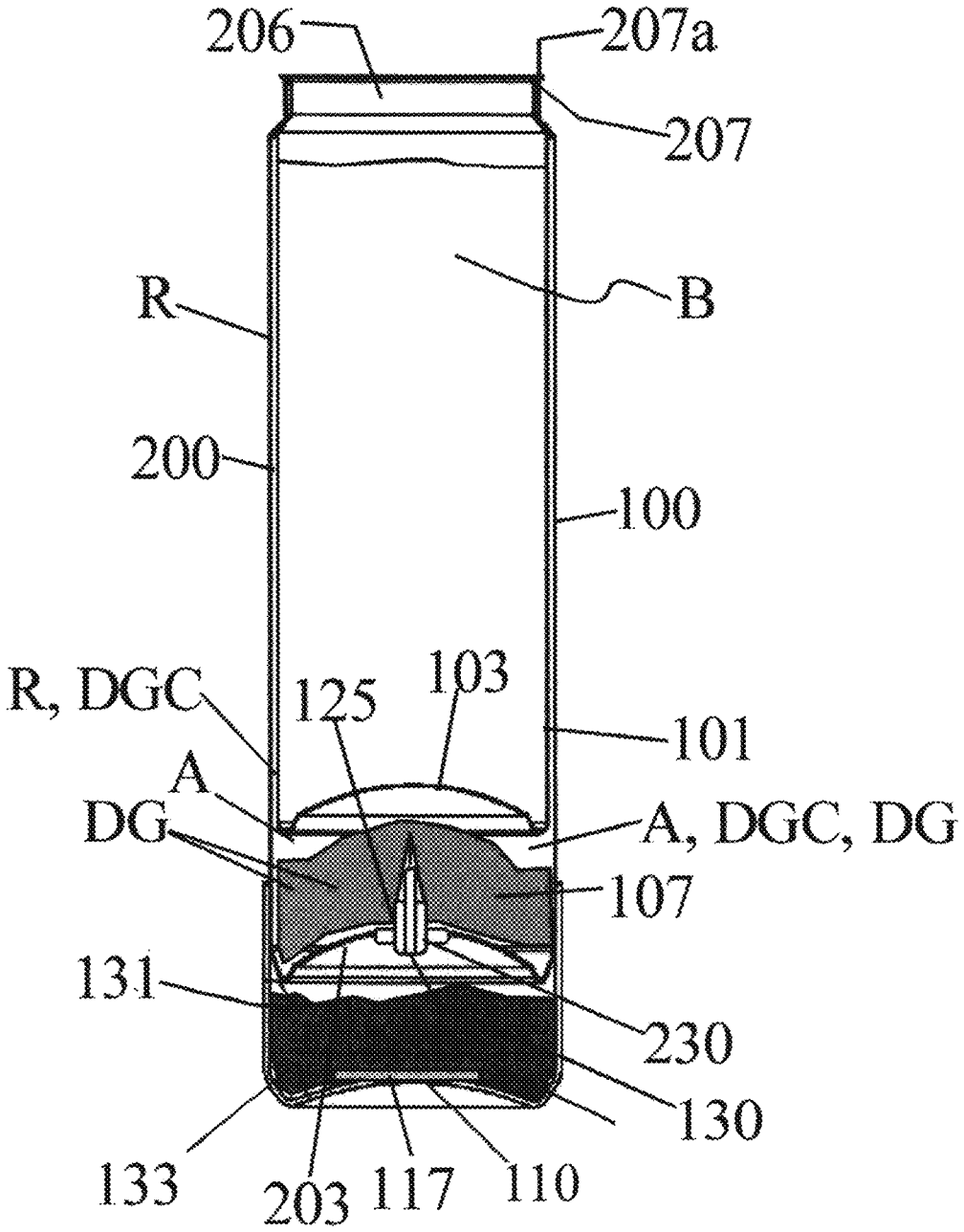
FIG. 15 shows a sectional view of the fourth embodiment of the invention. The humidification liquid chamber is shown as a separate attachable structure that sealingly and slidingly fits unto the base of the outer shell container. A molded cooling structure is also shown sitting inside the base dome of the outer shell container. The inner beverage container is shown holding a beverage in a completely sealed configuration. The outer shell container is shown to have a valve such as a duckbill valve to allow the passage of humidification liquid from the humidification liquid chamber covering the bottom of the outer shell container.

As shown in FIGS. 12 and 13, an open-ended humidification liquid chamber HLC is formed as a separate open cuplike container within the outer shell container 100 in the cylindrical space A. The humidification liquid chamber HLC has a humidification liquid chamber outer cylindrical wall 132 that slidingly fits on outer shell container inner cylindrical wall 101. The humidification liquid chamber HLC is manufactured by means of either stamping aluminum or by means of plastic injection molding. The humidification liquid chamber HLC is configured with a stepped well 123 that has vapor passageways 110 in the form of an array of tiny holes through it as shown. The vapor passageways 110 should be no more than inch in diameter and should be as many as possible to allow free passage of dry gas and prevent back pressure build up. A filtration membrane 117 is placed on the inside surface of the stepped well 123 to block off any liquid passage through the vapor passageways 110 passing through the stepped well 123. An outer shell container dome hole 125 is made through the center of the outer shell container base dome 103 to allow the stepped well 123 to freely pass and project through the outer shell container the base dome 103. The outer shell container dome hole 125 is between 0.5" to 1.5" in diameter and should just allow the stepped well 123 of the humidification liquid chamber HLC to pass through it. A filtration membrane 117 made from a thin hydrophobic membrane of Polytetrafluoroethylene (PTFE) with pore sizes such as 0.05 um, 0.10 um, 0.22 um, 0.45 um, 1 um, 2 um, 3 um, 5 um, is attached by a strong hydrophobic and water compatible adhesive 118 to cover the vapor passageways 110 on the inside surfaces of stepped well 123 to prevent any liquids from passing through them. Humidification liquid HL is filled into the humidification liquid chamber HLC and a breakable compressible barrier 128 made from a suitable material such as a wax layer, a thin plastic or aluminum foil barrier, is placed the humidification liquid chamber HLC to seal the humidification liquid chamber open rim 126. The compressible barrier 128 material must be able to compress and break into a non-sealing configuration when stressed by finger pressure F. In this embodiment the humidification liquid chamber HLC is manufactured as a separate container to hold humidification liquid HL, and is positioned inside the outer shell container 100 to sit in the cylindrical space A and slide freely but sealingly against the outer shell container inner cylindrical wall 101. This conforms to the second embodiment of the invention with the dry gas chamber formed by the cylindrical space A between the containers. Grease may be used to effectuate a proper seal between the humidification liquid chamber outer cylindrical walls 132 and the outer shell container cylindrical wall 101 inner surface.

As before, the cooling structure 107 is prepared in the manner prescribed by the second embodiment, i.e. as a cylindrical structure is made according to the second embodiment of the invention to sit in the annular radial space R between the containers.

The next step of manufacturing the apparatus according to the third embodiment is to place the humidification liquid chamber HLC, with the humidification liquid HL sealed within it by compressible barrier 128, to sit inside the cylindrical space A, and allowing the stepped well 123 to project through the outer shell container base dome hole 125, preferably without the stepped well 123 projecting beyond the outer shell container base edge 129. Thus, the outer shell container 100 preferably will sit on outer shell container base edge 129 as usual.

The next step is to insert the inner beverage container 200 through the outer shell container open rim 106 until the inner beverage container sealing flange 107*a* rests and snugly sits on the outer shell container sealing flange 207*a*. The next step is just filling a beverage B into the inner beverage container 200 using conventional beverage filling machines, and then seaming a beverage container lid 113 to co-seam and seal both the inner beverage container sealing flange 207*a* and the outer shell container sealing flange 107*a* to the beverage container lid flange 207*c*. The apparatus is now ready to be used as invented.

To activate the cooling of the apparatus 10, a user simply turns the unit upside down and pushes the stepped well 123 of the humidification liquid chamber HLC to break the compressible barrier 128
with the inner beverage container bottom edge 205. The humidification liquid HL spills into and contacts the cooling structure 107 and starts to agitate the cooling structure 107 to endothermically dissolve and cool and also to release dry gas DG and humidify the dry gas DG for further cooling.

While there many other means of forming the cooling structure of each embodiment that have not been described, it is obvious to one skilled in the art that a variety of methods could be used to achieve the same goal. Apart from $CO_2$ other environmentally friendly gases may be used with the invention. For example, Dry Air and Dry Nitrogen may be used even though it will only be stored in gaseous form. It is anticipated that the cost of the components needed to mass manufacture apparatus in the forms shown above is less than US $0.10 per unit. The wax seal forming the compressible barrier structure C may be replaced by a simple plastic layer 228 forming a barrier. One-way duckbill valves 230 may be used with small tubes (not shown) connect the dry gas chamber DGC to the humidification liquid chamber HLC and allow a one way flow of the humidification liquid HL in instances where carbonation pressure is used to pump the humidification liquid HL into the dry gas chamber DGC when carbonation pressure is released by opening the beverage container opening means 116.

Alternative material selections can be used to form the inner beverage container 200 and the outer shell container 100. For example, plastic, rather than aluminum containers may be used to achieve the same purposes. In the case of a plastic outer shell container 100, the open end 106 may be left open for insertion of either humification liquid HL or cooling structures 107. Then the open end 106 can be heat shrunk to seal and form the two chambers. HLC and DGC.

Method of Manufacture of the Fourth Embodiment of the Present Invention

A fourth embodiment of the invention is shown in FIGS. 15-18.

As before, the fourth embodiment of the invention requires two conventional beverage containers with matched sizes to serve the purposes of an outer shell container 100 and an inner beverage container 200 that form part of apparatus 10. The outer shell container 100 and the inner beverage container 200 are chosen, once again, such that the outer diameter of the inner beverage container 200 fits snugly through the outer shell container open rim 106, which has a larger diameter than the inner beverage container cylindrical wall 202 outer surface. The inner beverage container 200 is chosen to have a height that is less than the outer shell container 100.

The gap between the height of the outer shell container base dome 103 and the height of the inner beverage container base dome 203 forms a cylindrical space A between them. The gap between the diameter of the outer shell container cylindrical wall 111 and the diameter of the inner beverage container cylindrical wall 201 forms an annular radial space R between them.

In this case, the cylindrical space A and the annular radial space R together form a dry gas chamber DGC that will hold a cooling structure 107 impregnated with a dry gas DG.

Figure 16:
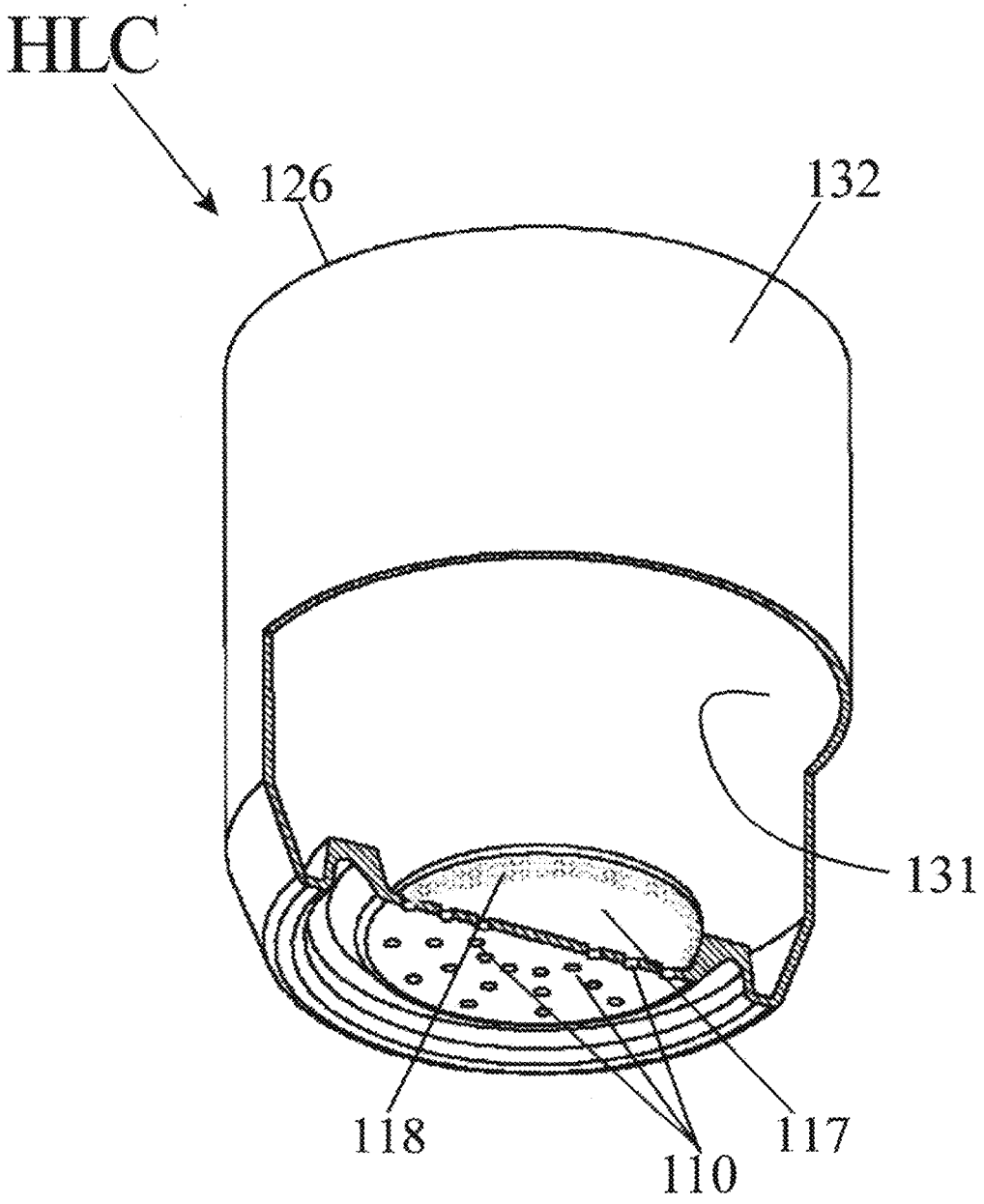
FIG. 16 shows a cut away view of the fourth embodiment of the invention's humidification liquid chamber with a filtration membrane attached to cover over dry gas passageways to prevent humidification liquid from exiting the humidification liquid chamber while only allowing dry gas to exist through dry gas passage holes to atmosphere.
Figure 17:
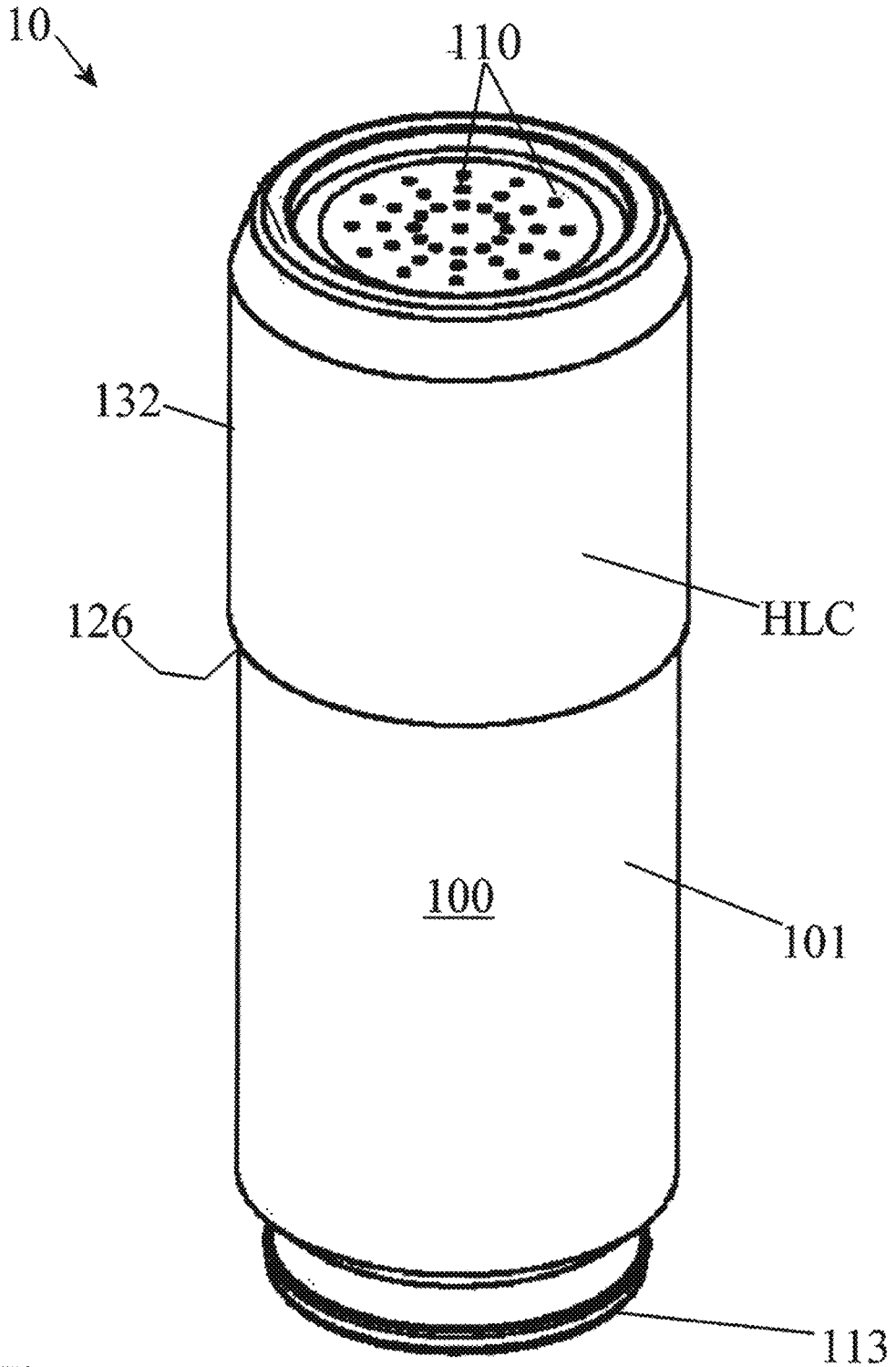
FIG. 17 shows the apparatus according to the fourth embodiment with the inner beverage container and the outer shell container forming a dry gas chamber holding the dry gas cooling structure. The humidification liquid chamber with humidification liquid contained therein is shown as a separate attached structure that sealingly and slidingly fits around the base of the outer shell container. A breakable barrier such as a sealing membrane and a wax layer is shown blocking a humidification liquid passageway through the outer shell container domed base. The dry gas cooling structure is also shown beneath the inner beverage container supporting against the base dome of the outer shell container it from carbonation stresses.
Figure 18:
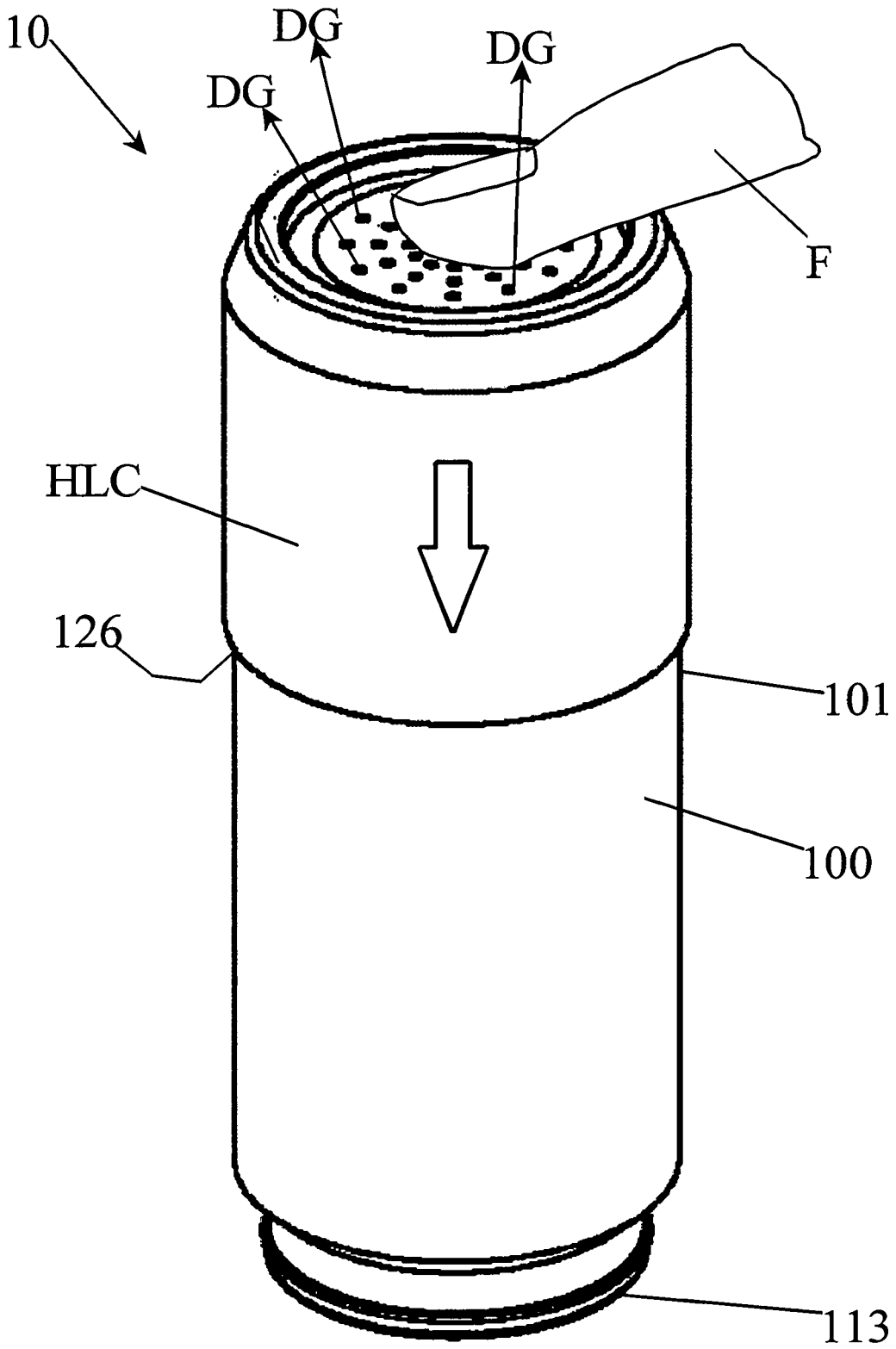
FIG. 18 shows a finger pushing the humidification liquid canister to sealingly slide on the outer shell container to break the compressible barrier and allow humidification liquid to enter into the dry gas chamber.

As shown in FIGS. 15-18, a humidification liquid chamber HLC is formed as a separate part, as in the third embodiment. In this case, the humidification liquid chamber HLC is formed with a humidification liquid chamber HLC bottom wall 133, a humidification liquid chamber cylindrical wall 131 inner surface and a humidification liquid chamber outer cylindrical wall 132. The humidification liquid chamber HLC is designed to cap over and cover the outer shell container base dome 103 such that the humidification liquid chamber inner cylindrical wall 131 sealingly slides over the outer shell container cylindrical wall 102 outer surface. The humidification liquid chamber HL is therefore configured like a cup with a humidification liquid chamber HL bottom wall 133 that has several vapor passageways 110 in the form of an array of small pin holes that pass through it as shown in FIGS. 16 17, and 18. The vapor passageways 110 should be no more than ¼ inch in diameter and should be as many as possible to allow free passage of dry gas DG and prevent back pressure build up. A filtration membrane 117 is placed on the inside surface of the humidification liquid chamber HLC bottom wall 133 to block any liquid from passing through the vapor passageways 110. A outer shell container dome hole 125 with a diameter of about ¼ to ½" is made through the outer shell container base dome 103.

A compressible barrier structure 128, such as a wax, is placed to seal off the humidification liquid passageway 130 to prevent humidification liquid HL from freely passing through into the outer shell container 100 from the humidification liquid chamber HLC. The compressible barrier structure 128 could also be a duckbill valve 230 in a different barrier that only allows flow into the outer shell container 100 from the humidification liquid chamber HLC when pressure is applied to the humidification liquid HL.

Grease and other sealing agents that allow the Humidification liquid chamber HLC to freely slide in a sealing configuration is applied to layer the humidification liquid chamber cylindrical walls 131 inner surface, and the humidification liquid chamber HLC is slid to cover over the outer shell container cylindrical wall 102 outer surface. A tape may be applied around the edges of the humidification liquid chamber open rim 126 to hold it in place on the outer shell container cylindrical wall 102 outer surface.

As before, the cooling structure 107 is prepared and positioned as per any of the prior embodiments described herein and in any combinations thereof without limiting the scope of the invention. A dry gas DG, such as Dimethyl ether or $CO_2$ is then flowed into the outer shell container 100 to remove any traces of air.

Once again, the next step is to insert the inner beverage container 200 through the outer shell container open rim 106 until the inner beverage container sealing flange 107*a* rests and snugly sits on the outer shell container sealing flange 207*a*. The next step is just filling a beverage B into the inner beverage container 200 using conventional beverage filling machines and seaming a beverage container lid 113 to co-seam and seal both the inner beverage container sealing flange 207*a* and the outer shell container sealing flange 107*a* to the beverage container lid flange 207*c*. Beverage container lid 113 has a beverage opening means 116 and a scored portion 116*a* that can be easily broken to open by means of the beverage container opening means for consuming the beverage B, using a finger pull motion as is conventionally done. The apparatus 10 is now ready to be used as invented.

To activate the invention, the humidification liquid chamber HLC is simply pushed to sealingly slide over the outer shell container cylindrical wall 102 outer surface and break the compressible barrier 128 to empty the humidification liquid HL through the humidification liquid passageway 130. The dry gas DG in the outer shell container 100 absorbs humidification liquid HL and generates a vacuum to further pull the humidification liquid HL into the dry gas chamber DGC. The cooling structure 107 dissolves and endothermically cools the beverage B.

While there many other means of forming the cooling structure of each embodiment that have not been described, it is obvious to one skilled in the art that a variety of methods could be used to achieve the same goal. Once again, apart from $CO_2$ other environmentally friendly gases may be used with the invention. For example, Dry Air and Dry Nitrogen may be used, even though it will only be stored in gaseous form. It is anticipated that the cost of the components needed to mass manufacture the apparatus 10 in the forms shown above is less than US $0.10 per unit. The wax seal forming the compressible barrier structure C may be replaced by a simple plastic layer 228 forming a barrier. One-way duckbill valves 230 may be used with small tubes to connect the dry gas chamber DGC to the humidification liquid chamber HLC and allow a one way flow of the humidification liquid in instances where carbonation pressure is used to pump the humidification liquid HL into the dry gas chamber DGC when carbonation pressure is released by opening the beverage container opening to means 116. Alternative material selections can be used, once again, to form the inner beverage container 200 and the outer shell container 100. For example, plastic rather than aluminum containers may be used to achieve the same purposes. In the case of a plastic outer shell container 100, the open end may be left open for insertion of either humidification liquid HL or cooling structures 107. Then the open end 106 can be heat shrunk to seal and form the two chambers 100 and 200.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A cooling apparatus for cooling food products, comprising:

an inner beverage container for containing a food product and having an inner beverage container rim and an inner beverage container cylindrical wall and an inner beverage container base dome;

an outer shell container having an outer shell container open rim, and an outer shell container cylindrical wall and an outer shell container base dome, where said inner beverage container is fitted into said outer shell container outer open rim such that said inner beverage container rim is adjacent to said outer beverage container rim;

wherein said inner beverage container has a height that is less than the height of said outer shell container, such that there is a cylindrical space between said inner beverage container base dome and said outer shell container base dome defining a dry gas chamber containing a dry gas and a cooling structure, and wherein the diameter of said inner beverage container cylindrical wall is less than the diameter of said outer shell container cylindrical wall, such that there is a radial space between said inner container cylindrical wall and said outer container cylindrical wall defining a humidification liquid chamber containing a humidification liquid.

2. A product temperature change container apparatus, comprising:

a product container for containing a product;

a humidification liquid chamber in thermal communication with said product container;

a humidification liquid contained within said humidification liquid chamber;

a dry gas chamber in thermal communication with said product container and in fluid communication with said humidification liquid chamber comprising a thermally reactive structure containing interstitial spaces for receiving and storing a dry gas;

a dry gas contained under pressure above ambient pressure within said dry gas chamber and within said interstitial spaces in said thermally reactive structure; and a compressible barrier structure between said humidification liquid chamber and said dry gas chamber for collapsing to open fluid communication between said chambers to activate cooling of a product in said product container, by permitting humidification liquid and dry gas to flow between said humidification liquid chamber and said dry gas chamber and thereby to intermix, wherein a temperature change of said product within said product container is generated by the absorption of humidification liquid by thermally reactive structure which then releases said dry gas as an absorbable medium for further thermodynamic cooling.

3. The apparatus of claim 2, comprising:

an outer container in the form of an outer can having an outer can first end tapering inwardly to an outer can opening to define a conical neck portion, said outer can opening being surrounded by an outer can rim, an outer can cylindrical wall and an outer can second end with can outer an second end wall;

wherein said product container is a product can, said product can having a product can first end with a product can opening surrounded by a product can rim, a product can cylindrical wall and a product can second end with a product can second end wall, said product can being fit sealingly fit through said outer can rim, creating an annular radial space between said product can cylindrical wall and said outer can cylindrical wall, said outer can being longer than said product can such that there is a cylindrical space between said product can second end wall and said outer can second end wall; and a can lid sealing fitted to said product can rim;

wherein said compressible barrier structure separates at least a portion of said annular radial space and said cylindrical space.

4. Tilt apparatus of claim 2, wherein said humidification liquid chamber comprises at least part of said annular radial space, and wherein said dry gas chamber comprises said cylindrical space.

5. The apparatus of claim 2, wherein said dry gas has a dew point within the range of 10 degrees Fahrenheit to −150 degrees Fahrenheit.

6. The apparatus of claim 2, wherein said thermally reactive structure comprises a thermally reactive block structure.

7. The apparatus of claim 6, wherein said thermally reactive block structure comprises granules of a chemical reactant in crystalline form with crystalline structures defining between them said interstitial spaces.

8. The apparatus of claim 7, wherein said thermally reactive structure is formed of at last one endothermic compound where the apparatus is to cool the product.

9. The apparatus of claim 8, wherein said endothermic compound is one of urea, potassium chloride, and nitrate salts.

10. The apparatus of claim 8, wherein said dry gas is at least one of: carbon dioxide, Solstice L41y (R-452B), Solstice 452A (R-452A), Solstice L40X (R-455A), Solstice zd, Solstice ze (R-1234ze), Solstice yf (R-1234yf), for cooling.

11. The apparatus of claim 7, wherein said dry gas is one of: Dimethyll ether and oxygen for heating.

12. A push-down product temperature change container apparatus, comprising:

an outer can having an outer can first end tapering inwardly to an outer can opening surrounded by an outer can rim, an outer can cylindrical wall and an outer can second end with an outer can second end wall;

a product can for containing a product, said product can having a product can first end with a product can opening surrounded by a product can rim, a product can cylindrical wall and a product can second end with a product can second end wall, wherein said product can is configured to fit sealingly through said outer can rim, defining an annular radial space between said product can cylindrical wall and said outer can cylindrical wall, said annular radial space being in thermal communication with said product can, and said outer can being longer than said product can such that there is a first cylindrical space between said product can second end wall and said outer can second end wall, wherein said first cylindrical space and at least a portion of said annular radial space together define a dry gas chamber;

a thermally reactive structure comprising an amount of dry gas, wherein said thermally reactive structure is configured to be disposed within said first cylindrical space of said dry gas chamber;

a can lid sealing fitted to said product can rim;

a humidification liquid chamber cup comprising a cup cylindrical wall configured to be fitted sealingly over and around and in slidable relation to said outer can cylindrical wall, and a cup end wall configured to be spaced from said outer can second end wall when said cup cylindrical wall is fitted sealingly over and around said outer can cylindrical wall, creating a second cylindrical space between said outer can second end wall and said cup end wall and defining a humidification liquid chamber, wherein said dry gas chamber and said humidification liquid chamber are capable of being in fluid communication with each other through a hole in said outer can second end wall;

wherein said hole is fitted with a one-way valve configured to prevent dry gas flow from the dry gas chamber into said humidification liquid chamber;

humidification liquid contained within said humidification liquid chamber;

and a vent opening in at least one of said outer can cylindrical wall and said outer can first end wall covered by a gas permeable and liquid impermeable membrane;

wherein when said outer can is pressed into said humidification liquid chamber cup, said outer can second end wall is caused to advance toward said humidification liquid cup end wall, causing humidification liquid to flow from said liquid chamber through said one-way valve, thereby causing heating or cooling of a product within said product container by causing said humidification liquid to flow into said dry gas chamber and thereby to intermix with said dry gas and thereby to surround and be in thermal communication with at least a portion of said product can cylindrical wall, wherein a temperature change of said product within said product container is generated by the absorption of humidification liquid by said thermally reactive structure which then releases a dry gas as an absorption medium for further thermodynamic heating or cooling.

13. The apparatus of claim 12, wherein said exothermic compound is one of silica gel crystals, sodium silicate and ferrous metals.

14. The apparatus of claim 13, wherein said one-way valve is a duck bill check valve.

15. The apparatus of claim 13, wherein pressing said outer can into said humidification liquid chamber cup, and thereby causing said outer second end wall to advance toward said cup end wall, and causing humidification liquid to flow from said liquid chamber through said one-way valve, permits heating or cooling of a product within said product container, by permitting humidification liquid to flow into said chamber for gas and thereby to intermix with said gas and thereby to surround and be in thermal communication with both said product can cylindrical wall and said product can second end wall.

16. The apparatus of claim 12, wherein said dry gas has a dew point within the range of 10 degrees Fahrenheit to −150 degrees Fahrenheit.

17. The apparatus of claim 16, wherein said thermally reactive structure comprises a thermally reactive block structure.

18. The apparatus of claim 17, wherein said thermally reactive block structure comprises granules of a chemical reactant in crystalline form with crystalline structures defining between them said interstitial spaces.

19. The apparatus of claim 18, wherein said thermally reactive structure is formed of at least one endothermic compound where the apparatus is to cool the product.

20. The apparatus of claim 19, wherein said endothermic compound is one of urea, potassium chloride, and nitrate salts.

21. The apparatus of claim 19, wherein said exothermic compound is one of silica gel crystals, sodium silicate and ferrous metals.

22. The apparatus of claim 12, wherein said dry gas is at least one of: carbon dioxide, Solstice L41y (R-452B), Solstice 452A (R-452A), Solstice L40X (R-455A), Solstice zd, Solstice ze (R-1234ze), Solstice yf (R-1234yf), for cooling.

23. The apparatus of claim 12, wherein said dry gas is one of: Dimethyl ether and oxygen for heating.

24. The apparatus of claim 12, wherein said cup end wall comprises at least one vapor passageway capable of permitting gas to pass therethrough to the ambient.

25. A press-activated product temperature change container apparatus, comprising:

an outer can having an outer can first end tapering inwardly to an outer can opening surrounded by an outer can rim, and having an outer can cylindrical wall and an outer can second end with an outer can second end wall;

a product can for containing a product, said product can having a product can first end with a product can opening surrounded by a product can rim, a product can cylindrical wall and a product can second end with a product can second end wall, said product can being fit sealingly through said outer can rim, defining an annular radial space between said product can cylindrical wall and said outer can cylindrical wall in thermal communication with said product can, said annular radial space defining a humidification liquid chamber, said outer earl being longer than said product can to creating a first cylindrical space between said product can second end wall and said outer can second end wall defining a chamber for gas;

a thermally reactive structure contained within said chamber for gas and comprising interstitial spaces for receiving and storing a gas;

a can lid sealingly fitted to said product can rim and having lid opening means;

humidification liquid contained within said humidification liquid chamber;

a gas contained under pressure above ambient pressure within said chamber for gas; and a compressible barrier structure comprising a deformable ring extending circumferentially around said product can and abutting said product can cylindrical wall and said outer can cylindrical wall, separating said humidification liquid chamber from said chamber for gas, for collapsing by a user pressing inward on said outer can cylindrical wall over said deformable ring to open fluid communication between said chambers to activate cooling of the product in said product container, by permitting humidification liquid and gas to flow between said humidification liquid chamber acid said chamber for gas and thereby to intermix, wherein a temperature change of the product within said product can is generated by the absorption of humidification liquid by thermally reactive structure which then releases said gas as an absorbable medium for further thermodynamic cooling.

26. The apparatus of claim 25, wherein said gas is a dry gas.

27. The apparatus of claim 25, additionally comprising a vent port in said outer can, said vent port being covered by a gas permeable and liquid impermeable membrane, for releasing gas when said outer can is pressed into said cup to activate product temperature change.

28. An opening-activated product temperature change container apparatus, comprising:

an outer can having an outer can first end tapering inwardly to an outer can opening surrounded by an outer can rim, an outer can cylindrical wall and an outer can second end with an outer can second end wall;

a product can for containing a product under pressure above ambient pressure, said product can having a product can first end with a product can opening surrounded by a product can rim a product can cylindrical wall and a product can second end with a product can second end wall, said product can being fit sealingly through said outer can rim, defining an annular radial space between said product can cylindrical wall and said outer can cylindrical wall in thermal communication with said product can, said annular radial space defining a humidification liquid chamber, said outer can being longer than said product can such that there is a cylindrical space between said product can second end wall and said outer can second end wall defining a dry gas chamber;

a thermally reactive structure contained within said dry gas chamber and comprising interstitial spaces for receiving and storing a gas;

a can lid sealingly fitted to said product can rim and having lid opening means;

humidification liquid contained within said humidification liquid chamber;

a gas contained under pressure above ambient pressure within said chamber for gas; and an annular barrier structure comprising a collapsible, resilient tube, said annular barrier structure extending circumferentially and sealingly around said product can and sealingly abutting said outer can cylindrical wall except where said tube extends between said product can cylindrical wall and said annular barrier structure, thereby separating said humidification liquid chamber from said dry gas chamber;

such that pressure within said product can presses outwardly and holds said product can cylindrical wall firm against inward collapse and holding said resilient tube sealingly flattened, until said lid opening means is operated, opening said product can and thereby releasing pressure within said product can, permitting the resilience of said resilient tube to cause said resilient tube to resiliently open, thereby opening fluid communication between said dry gas chamber and said humidification liquid chamber.

29. The apparatus of claim 28, wherein said outer can has a vent port covered by a gas permeable and water impermeable membrane.

30. A push-down product temperature change container apparatus, comprising:

an outer can having an outer can first end tapering inwardly to an outer can opening surrounded by an outer can rim, an cuter can cylindrical wall and an outer can second end with an outer and second end wall;

a product can for containing a product, said product can having a product can first end with a product can opening surrounded by a product can rim, a product can cylindrical wall and a product can second end with a product can second end wall, said product can being fit sealingly through said outer can rim, defining an annular radial space between said product can cylindrical wall and said outer can cylindrical wall in thermal communication with said product can, said outer can being longer than said product can such that there is a first cylindrical space between said product can second end wall and said outer can second end wall, said first cylindrical space and at least a portion of said annular radial space together defining a chamber for gas;

a thermally reactive structure within said chamber for gas having interstitial spaces;

a can lid sealingly fitted to said product can rim;

a humidification liquid chamber cup having a cup cylindrical wall fitted sealingly over and around and in slidable relation to said outer can cylindrical wall adjacent to said outer can second end, and having a cup end wall spaced from said outer can second end wall creating a second cylindrical space between said outer can second end wall and said cup end wall, defining a humidification liquid chamber, wherein said chamber for gas and said humidification liquid chamber are in fluid communication with each other through a hole in said outer can second end wall which is fitted with a check valve oriented to prevent gas flow into said humidification liquid chamber, and wherein said cup end wall comprises at least one gas passing vapor passageway;

humidification liquid contained within said humidification liquid chamber;

a gas contained within said chamber for gas and filling said interstitial spaces; and such that pressing said outer can into said humidification liquid chamber cup, and thereby causing said outer can second end wall to advance toward said cup end wall, and causing humidification liquid to flow from said liquid chamber through said check valve, permits cooling of a product within said product container, by permitting humidification liquid and gas to flow and be drawn by said gas and thereby into said chamber for gas and into said interstitial spaces, and thereby to intermix, wherein a temperature change of said product within said product container is generated by the absorption of humidification liquid by said thermally reactive structure which then releases a gas as an absorption medium for further thermodynamic cooling.

31. The apparatus of claim 30, wherein said gas is a dry gas having a dew point within the range of 10 degrees Fahrenheit to −150 degrees Fahrenheit.

32. The apparatus of claim 30, wherein said check valve is a duck bill check valve.

33. The apparatus of claim 30, wherein said gas is a dry gas having a dew point within the range of 10 degrees Fahrenheit to −150 degrees Fahrenheit.

34. The apparatus of claim 33, wherein said thermally reactive structure comprises a thermally reactive block structure.

35. The apparatus of claim 34, wherein said thermally reactive block structure comprises granules of a chemical reactant in crystalline form with crystalline structures defining between them said interstitial spaces.

36. The apparatus of claim 35, wherein said thermally reactive structure is formed of at least one endothermic compound where the apparatus is to cool the product.

37. The apparatus of claim 36, wherein said endothermic compound is one of urea, potassium chloride, and nitrate salts.

38. The apparatus of claim 36, wherein said exothermic compound is one of silica gel crystals, sodium silicate and ferrous metals.

39. The apparatus of claim 36, wherein said dry gas is at least one of: carbon dioxide, Solstice L41y (R-452B), Solstice 452A (R-452A), Solstice L40X (R.-455A), Solstice zd, Solstice ze (R-1234ze), Solstice yf (R-1234yf), for cooling.

40. The apparatus of claim 35, wherein said dry gas is one of: Dimethyl ether and oxygen for heating.

41. A push-down product temperature change container apparatus, comprising:

an outer can having an outer can first end tapering inwardly to an outer can opening surrounded by an outer can rim, an outer can cylindrical wall and an outer can second end with an outer and second end wall;

a product can for containing a product, said product can having a product can first end with a product can opening surrounded by a product can rim, a product can cylindrical wall and a product can second end with a product can second end wall, said product can being fit sealingly through said outer can rim, defining an annular radial space between said product can cylindrical wall and said outer can cylindrical wall in thermal communication with said product can, said outer can being longer than said product can such that there is a first cylindrical space between said product can second end wall and said outer can second end wall, said first cylindrical space and at least a portion of said annular radial space together defining a chamber for gas;

a thermally reactive structure within said chamber for gas having interstitial spaces;

a can lid sealingly fitted to said product can rim;

a humidification liquid chamber cup having a cup cylindrical wall fitted sealingly over and around and in slidable relation to said outer can cylindrical wall adjacent to said outer can second end, and having a cup end wall spaced from said outer can second end wall creating a second cylindrical space between said outer can second end wall and said cup end wall, defining a humidification liquid chamber, wherein said chamber for gas and said humidification liquid chamber are in fluid communication with each other through a hole in said outer can second end wall which is fitted with a check valve oriented to prevent gas flow into said humidification liquid chamber, and wherein said cup end wall comprises at least one gas passing vapor passageway;

humidification liquid contained within said humidification liquid chamber;

a gas contained within said chamber for gas and filling said interstitial spaces; and a vent opening in at least one of said outer can cylindrical wall and said outer can first end wall covered by a gas permeable and liquid impermeable membrane;

such that pressing said outer can into said humidification liquid chamber cup, and thereby causing said outer can second end wall to advance toward said cup end wall, and causing humidification liquid to flow from said liquid chamber through said check valve, permits cooling of a product within said product container, by permitting humidification liquid to flow and be drawn by said gas and thereby into said chamber for gas and into said interstitial spaces and thereby to intermix with said gas and to surround and be in thermal communication with at least said product can cylindrical wall, wherein a temperature change of said product within said product container is generated by the absorption of humidification liquid by said thermally reactive structure which then releases a gas as an absorption medium for further thermodynamic cooling.

42. The apparatus of claim 41, wherein said gas is a dry gas having a dew point within the range of 10 degrees Fahrenheit to −150 degrees Fahrenheit.

43. The apparatus of claim 42, wherein said thermally reactive structure comprises a thermally reactive block structure.

44. The apparatus of claim 42, wherein said thermally reactive block structure comprises granules of a chemical reactant in crystalline form with crystalline structures defining between them said interstitial spaces.

45. The apparatus of claim 44, wherein said thermally reactive structure is formed of at least one endothermic compound where the apparatus is to cool the product.

46. The apparatus of claim 45, wherein said endothermic compound is one of urea, potassium chloride, and nitrate salts.

47. The apparatus of claim 45, wherein said exothermic compound is one of silica gel crystals, sodium silicate and ferrous metals.

48. The apparatus of claim 45, wherein said dry gas is at least one of: carbon dioxide, Solstice L41y (R-452B), Solstice 452A (R-452A), Solstice L40X (R-455A), Solstice zd, Solstice ze (R-1234ze), Solstice yf (R-1234yf), for cooling.

49. The apparatus of claim 44, wherein said dry gas is one of: Dimethyl ether and oxygen for heating.

50. The apparatus of claim 41, wherein said check valve is a duck bill valve.

51. The apparatus of claim 41, wherein pressing said outer can into said humidification liquid chamber cup, and thereby causing said outer can second end wall to advance toward said cup end wall, and causing humidification liquid to flow from said liquid chamber through said check valve, permits cooling off of gas and thereby to intermix with said gas and thereby to surround and be in thermal communication with both said product can cylindrical wall and said product can second end wall.

* * * * *